US007132639B2

(12) United States Patent
Shimoi et al.

(10) Patent No.: US 7,132,639 B2
(45) **Date of Patent: *Nov. 7, 2006**

(54) PHOTOMULTIPLIER AND RADIATION DETECTOR

(75) Inventors: Hideki Shimoi, Hamamatsu (JP); Hiroyuki Kyushima, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/189,135

(22) Filed: Jul. 26, 2005

(65) Prior Publication Data

US 2006/0091287 A1 May 4, 2006

(30) Foreign Application Priority Data

Oct. 29, 2004 (JP) ..... P2004-316539

(51) Int. Cl.
*H01J 21/20* (2006.01)
*H01J 43/04* (2006.01)

(52) U.S. Cl. ..... 250/214 VT; 250/207; 313/103 R; 313/532

(58) Field of Classification Search ..... 250/207, 250/214 VT, 370.11, 370.08; 313/103 R, 313/532, 523–544, 103, 103 CM, 104, 105 R, 313/105 CM; 315/11, 12.1
See application file for complete search history.

(56) References Cited

U.S. PATENT DOCUMENTS 5,498,926 A * 3/1996 Kyushima et al. ..... 313/533
5,504,386 A * 4/1996 Kyushima et al. ..... 313/103 R
5,864,207 A * 1/1999 Kume et al. ..... 313/533
6,472,664 B1 * 10/2002 Kyushima et al. ..... 250/366
2003/0102802 A1 * 6/2003 Kyushima et al. ..... 313/533

FOREIGN PATENT DOCUMENTS

JP 05-290793 A 11/1993
JP 2002-203508 7/2002

OTHER PUBLICATIONS

U.S. Appl. No. 11/189,023, filed Jul. 26, 2005, Hideki Shimoi et al.
U.S. Appl. No. 11/189,108, filed Jul. 26, 2005, Hideki Shimoi et al.
U.S. Appl. No. 11/189,006, filed Jul. 26, 2005, Hideki Shimoi et al.

* cited by examiner

*Primary Examiner*—Stephone B. Allen
*Assistant Examiner*—Davienne Monbleau
(74) *Attorney, Agent, or Firm*—Drinker Biddle & Reath LLP

(57) ABSTRACT

A holding member or a base member, through which stem pins are passed and one surface of which is held by the holding member, is joined to the stem pins and the holding member by fusion by the melting of the base member. Upon melting, a volume of the base member is made to escape into a base member seep portion, and a stem is arranged as a two-layer arrangement formed by the holding of the base member by the holding member. When the holding member is joined to the inner surface of the base member, the inner surface of the stem is improved in positional precision, flatness, and levelness, while when the holding member is joined to the outer surface of the base member, the outer surface of the stem is improved in positional precision, flatness, and levelness.

3 Claims, 22 Drawing Sheets

(a)

(b)

(a)

(b)

(a)

(b)

(a)

(b)

PHOTOMULTIPLIER AND RADIATION DETECTOR

BACKGROUND OF THE INVENTION

1. Field of the Invention

This invention concerns a photomultiplier that makes use of the photoelectric effect and a radiation detector that uses this photomultiplier.

2. Related Background of the Invention

As one type of photomultiplier, a so-called head-on photomultiplier is known. With this head-on photomultiplier, a sealed vacuum container is arranged by providing a light receiving plate at an end portion at one side of a cylindrical side tube and providing a stem at an end portion at the other side of the side tube, and a photoelectric surface is disposed on the inner surface of the light receiving plate. An arrangement is provided wherein an electron multiplier unit, with a plurality of stages of dynodes, and an anode are layered and positioned opposite the photoelectric surface, and a plurality of stem pins, respectively connected to the respective dynodes and the anode, are insertedly mounted in the stem so as to lead to the exterior from inside the sealed container. Incident light that is made incident through the light receiving plate is converted into electrons at the photoelectric surface, the electrons that are emitted from the photoelectric surface are successively multiplied at the electron multiplier unit, wherein predetermined voltages are applied via the respective stem pins to the respective diodes, and the electrons that reach the anode upon being multiplied are taken out as an electrical signal via an anode pin, which is one of the stem pins.

Among such photomultipliers, there is an arrangement, wherein the stem pins are respectively mounted insertedly in a metal stem via tapered hermetic glass and the anode and the electron multiplier unit are layered above the plurality of stem pins, and an arrangement, wherein the stem pins are directly mounted insertedly in a stem formed of a large, tapered hermetic glass and the anode and the electron multiplier unit are layered on this stem (see, for example, FIG. 1 and FIG. 7 of Japanese Published Unexamined Patent Application No. Hei. 5-290793).

SUMMARY OF THE INVENTION

The former arrangement (the arrangement illustrated in FIG. 1 of Japanese Published Unexamined Patent Application No. Hei 5-290793) requires hermetic glass of a number corresponding to the number of stem pins and a step of setting each of these portions at a stem pin insertion position along with each stem pin. The number of parts and the number of manufacturing steps are thus large, and furthermore, since the anode and the electron multiplier unit are layered above the plurality of stem pins, the resistance against vibration is low and, for example, the hermetic glass becomes chipped due to mechanical stress applied to the stem pins.

Meanwhile, with the latter arrangement (the arrangement illustrated in FIG. 7 of Japanese Published Unexamined Patent Application No. Hei 5-290793), the respective stem pins are insertedly mounted in a single tapered hermetic glass that serves as the stem, and the anode and the electron multiplier unit are layered on this tapered hermetic glass. Though improvements are thus made in regard to the issues of the former arrangement, since the tapered hermetic glass and the respective stem pins are generally joined by fusing by the melting of the hermetic glass, the respective surfaces (the upper and lower surfaces in the figure) of the stem formed of hermetic glass are low in positional precision, flatness, and levelness and thus give rise to the following issues.

That is, when the positional precision, flatness, and levelness of the inner surface (upper surface) of the stem are degraded, the positional precision of the interval between the photoelectric surface and the electron multiplier unit, which is installed on the inner surface of the stem, is degraded, causing degradation of characteristics and lowering of the seating property of the electron multiplier unit. Meanwhile, when the positional precision, flatness, and levelness of the outer surface (lower surface) of the stem are degraded, the dimensional precision of the total length of the photomultiplier is degraded and the mounting property regarding surface mounting of the photomultiplier, for example, onto a circuit board, etc., is degraded.

This invention has been made to resolve such issues, and an object thereof is to provide a photomultiplier, with which the positional precision of the interval between a photoelectric surface and an electron multiplier unit is improved to enable predetermined characteristics to be obtained and the seating property of the electron multiplier unit to be improved, and a radiation detector equipped with such a photomultiplier, or to provide a photomultiplier, with which the dimensional precision of the total length of the photomultiplier and the mounting property regarding surface mounting of the photomultiplier are improved, and a radiation detector equipped with such a photomultiplier.

This invention's photomultiplier comprises: a photoelectric surface, disposed inside a sealed container, which is put in a vacuum state, and converting incident light made incident through a light receiving plate into electrons, which forms an end portion at one side of the sealed container; an electron multiplier unit, disposed inside the sealed container and multiplying electrons emitted from the photoelectric surface; an anode, disposed inside the sealed container and used for taking out the electrons multiplied by the electron multiplier unit as an output signal; a stem, forming an end portion at the other side of the sealed container and having a base member, with an insulating property, and a holding member, having a melting point higher than that of the abovementioned base member and being joined to one of an inner surface and an outer surface of the abovementioned base member; and a plurality of stem pins, insertedly mounted in the stem and leading to the exterior from inside the sealed container and electrically connected to the anode and the electron multiplier unit; with the stem pins being passed through and joined to the base member, the electron multiplier unit and the anode being layered on the inner surface of the stem, and the base member and the holding member, and the base member and the stem pins are respectively joined by fusion by the melting of the base member, and at least one of the holding member and the base member is provided with a base member seep portion into which the base member seeps upon melting.

With this photomultiplier, the base member, through which the stem pins are passed and one surface of which is held by the holding member, is joined to the stem pins and the holding member by fusion by the melting of the base member. Furthermore, a volume of the base member escapes satisfactorily into the base member seep portion upon melting, and the stem is arranged as a two-layer arrangement formed by the holding of the base member by the holding member. Thus in comparison to the conventional arrangement wherein the stem is arranged as a single layer of glass material and this is melted for fusion with the stem pins, in the case where the holding member is joined to the inner surface of the base member, the inner surface of the stem is improved in positional precision, flatness, and levelness and consequently, the positional precision of the interval between the electron multiplier unit, which is installed on the inner surface of the stem, and the photoelectric surface is improved, the predetermined characteristics can be obtained, and the seating property of the electron multiplier unit is improved. Meanwhile, in the case where the holding member is joined to the outer surface of the base member, the outer surface of the stem is improved in positional precision, flatness, and levelness and consequently, the dimensional precision of the total length of the photomultiplier and the mounting property regarding surface mounting of the photomultiplier are improved.

Here, the holding member may have a plurality of openings, through which the stem pins joined to the base member are inserted, and among these openings, at least two may be made larger in diameter than the other openings. With this arrangement, the entry of a positioning jig into the openings is enabled, thus facilitating the positioning of the base member and the holding member and enabling the lowering of the manufacturing cost. Also, since the openings, through which the stem pins are inserted, are made large in diameter and the positioning jig is made to enter these openings for positioning of the base member and the holding member, the concentricity of the stem pins and the openings of the holding members are secured.

Also, by installing a scintillator, which converts radiation into light and emits the light, at the outer side of the light receiving plate of the above-described photomultiplier, a favorable radiation detector that exhibits the abovementioned actions is provided.

DESCRIPTION OF THE PREFERRED EMBODIMENTS

Figure 1:
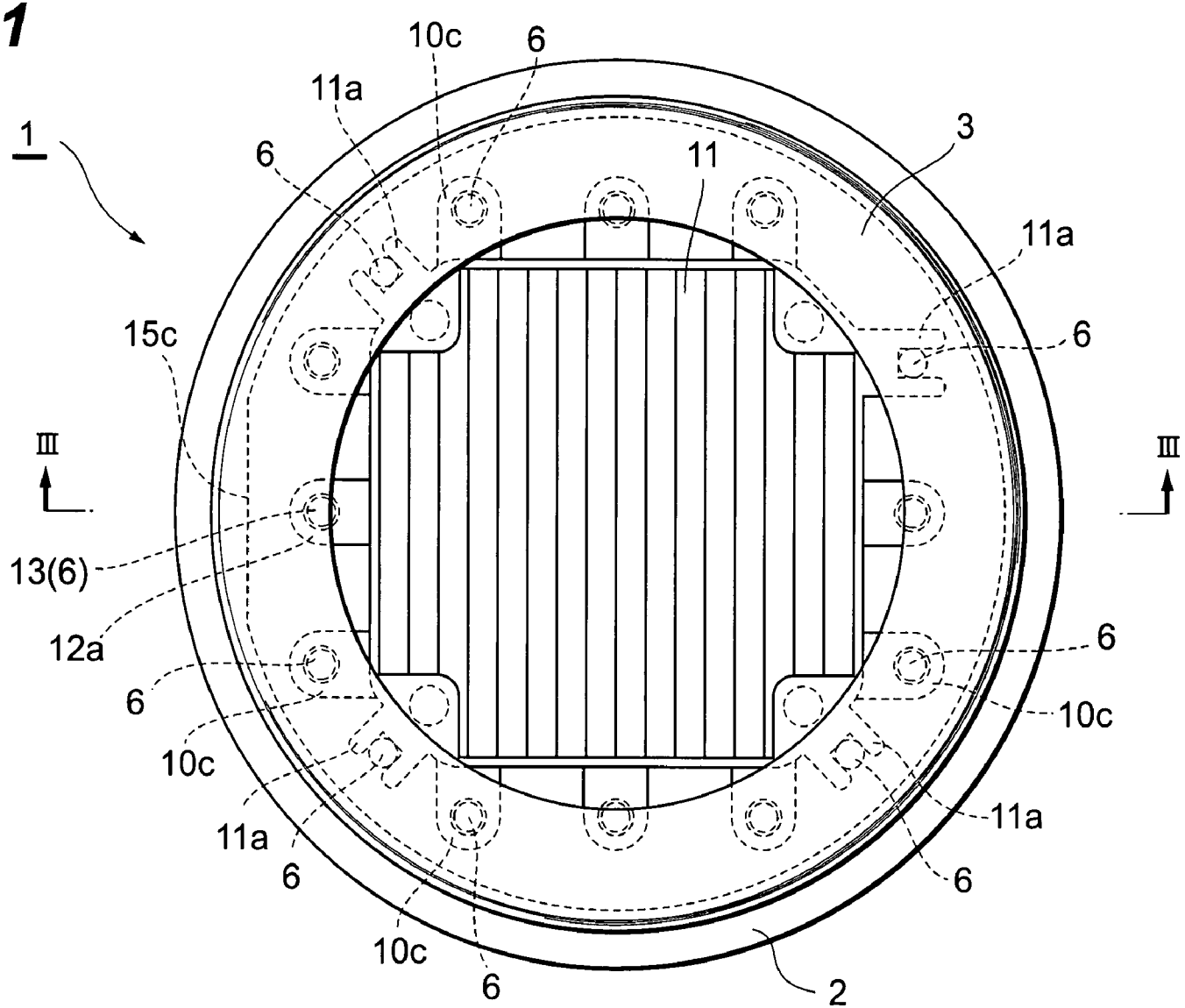
FIG. 1 is a plan view of a photomultiplier by this invention.

Preferred embodiments of this invention's photomultiplier and radiation detector shall now be described with reference to the drawings. The terms, "upper," "lower," etc., in the following description are descriptive terms based on the states illustrated in the drawings. In the drawings, portions that are the same or correspond to each other are provided with the same symbol and overlapping description shall be omitted.

Figure 2:
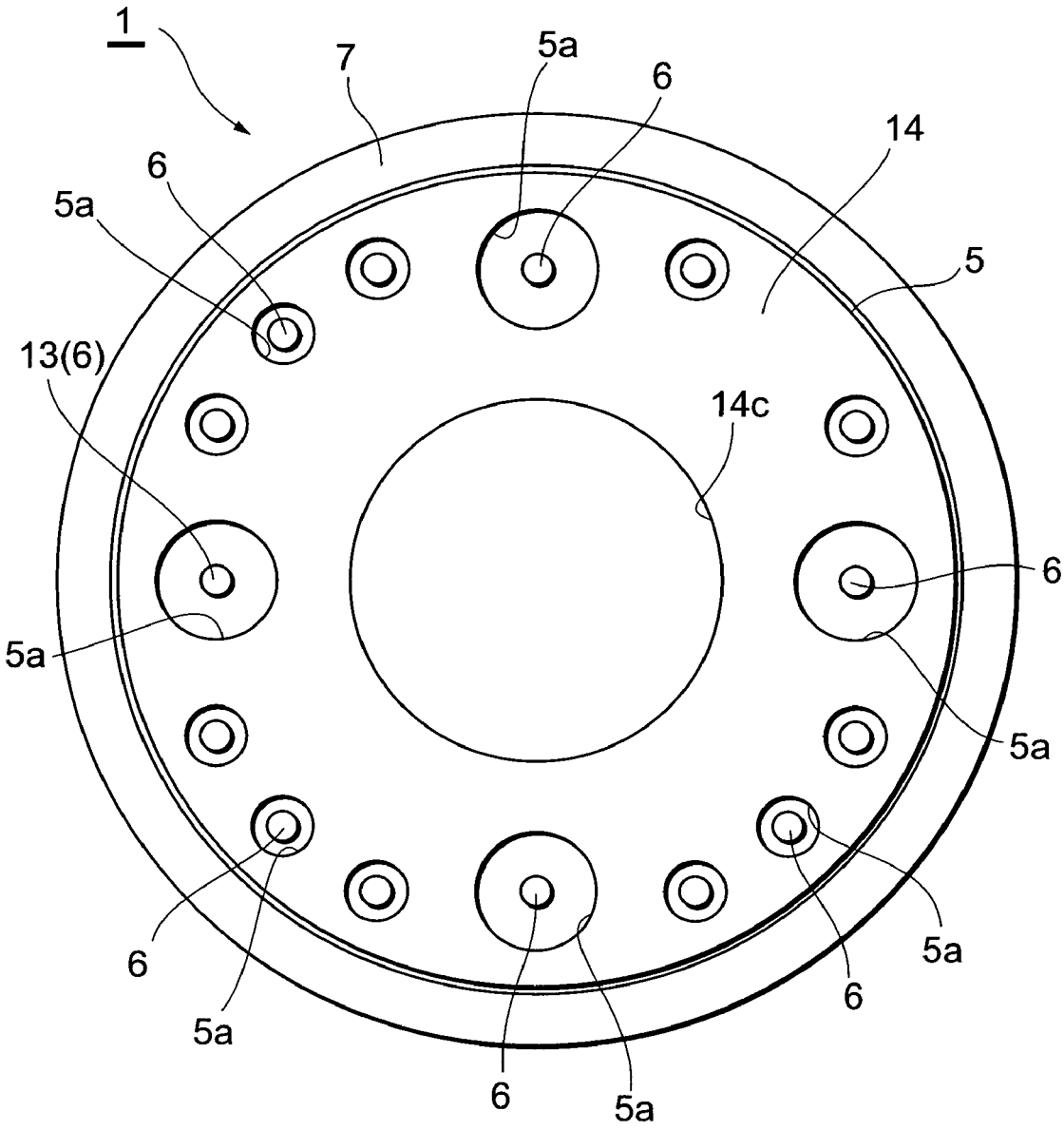
FIG. 2 is a bottom view of the photomultiplier shown in FIG. 1.
Figure 3:
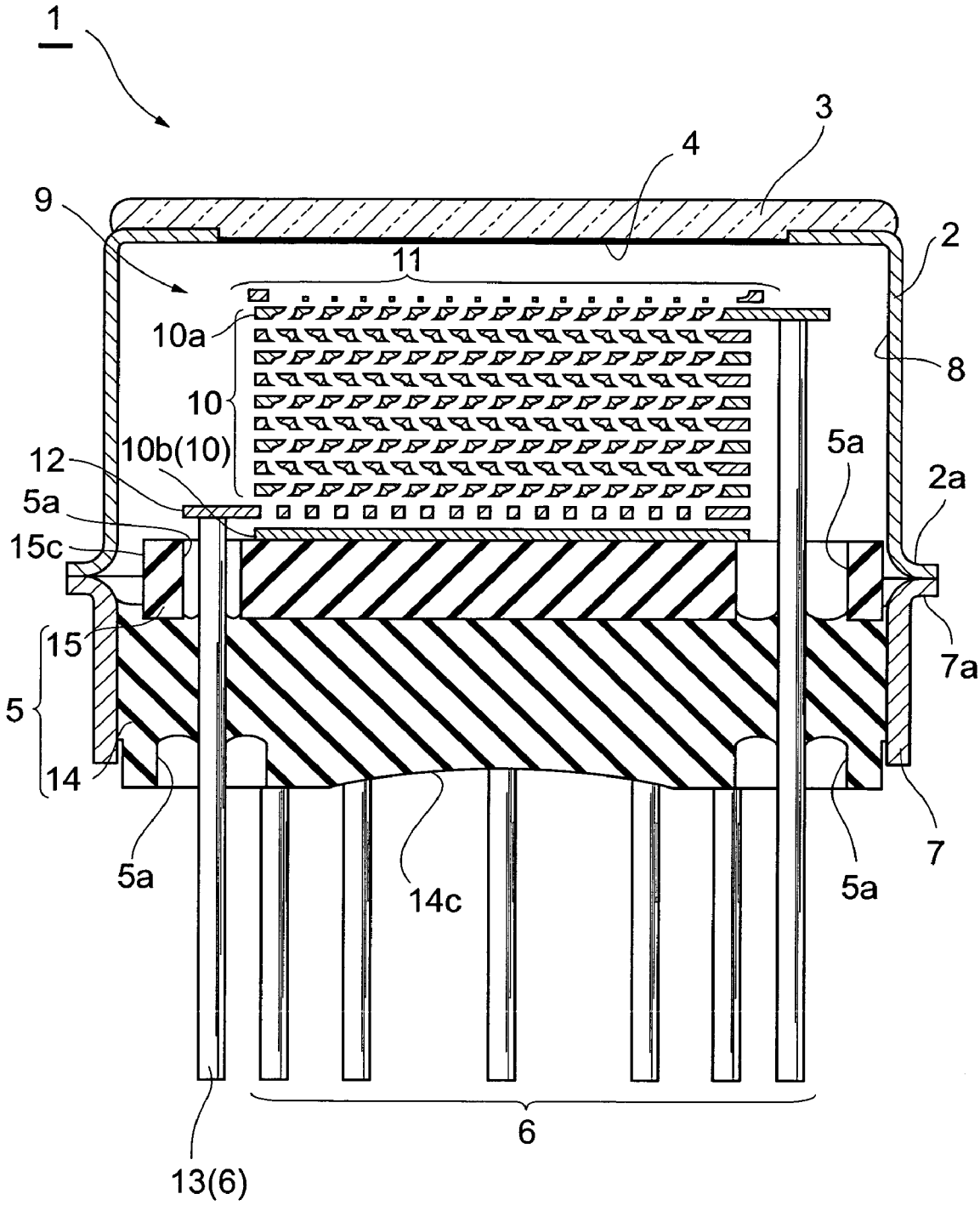
FIG. 3 is a sectional view taken along line III—III of the photomultiplier shown in FIG. 1.

FIG. 1 and FIG. 2 are a plan view and a bottom view, respectively, of an embodiment of a photomultiplier by this invention, and FIG. 3 is a sectional view taken along line III—III in FIG. 1. In FIG. 1 to FIG. 3, a photomultiplier 1 is arranged as a device that emits electrons upon incidence of light from the exterior and multiplies and outputs the electrons as a signal.

As shown in FIG. 1 to FIG. 3, the photomultiplier 1 has a metal side tube 2 with a substantially cylindrical shape. As shown in FIG. 3, a glass light receiving plate 3 is fixed in an airtight manner to an open end at the upper side (one side) of the side tube 2, and a photoelectric surface 4, for converting the light made incident through the light receiving plate 3 into electrons, is formed on the inner surface of the light receiving plate 3. Also, a disk-like stem 5 is positioned at an open end at the lower side (other side) of the side tube 2 as shown in FIG. 2 and FIG. 3. A plurality (15) of conductive stem pins 6, which are positioned apart from each other in the circumferential direction at positions substantially along a circle, are insertedly mounted in an airtight manner in the stem 5, and a metal, ring-like side tube 7 is fixed in an airtight manner so as to surround the stem 5 from the side. As shown in FIG. 3, a flange portion 2*a*, formed at a lower end portion of the upper side tube 2, and a flange portion 7*a* of the same diameter, formed at the lower ring-like side tube 7, are welded together, and by the side tube 2 and the ring-like side tube 7 being thereby fixed in an airtight manner, a sealed container 8, the interior of which is kept in a vacuum state, is formed.

Inside the sealed container 8, which is formed thus, is housed an electron multiplier unit 9 for multiplying the electrons emitted from the photoelectric surface 4. With this electron multiplying portion 9, a plurality of stages (ten in the present embodiment) of thin, plate-like dynodes 10, each having a plurality of electron multiplying holes, are laminated and formed as a block and installed on the upper surface of the stem 5. As shown in FIG. 1 and FIG. 3, at a predetermined peripheral portion of each dynode 10 is formed a dynode connecting tab 10*c*, which protrudes to the exterior, and a tip portion of a predetermined stem pin 6, insertedly mounted in the stem 5, is fixed by welding to the lower surface side of each dynode connecting tab 10*c*. The respective dynodes 10 are thus electrically connected respectively to the stem pins 6.

Furthermore, inside the sealed container 8, a plate-like focusing electrode 11, for converging and guiding the electrons emitted from the photoelectric surface 4 to the electron multiplier unit 9, is formed between the electron multiplier unit 9 and the photoelectric surface 4, and a plate-like anode 12, for taking out the electrons, multiplied by the electron multiplier unit 9 and emitted from the dynode 10*b* of the final stage, as an output signal, is layered at the stage one stage above the dynode 10*b* of the final stage as shown in FIG. 3. As shown in FIG. 1, protruding tabs 11*a*, which protrude outward, are formed respectively at the four corners of the focusing electrode 11, and by the predetermined stem pins 6 being fixed by welding to the respective protruding tabs 11*a*, the stem pins 6 are electrically connected to the focusing electrode 11. Also, an anode connecting tab 12*a*, which protrudes outward, is formed at a predetermined peripheral portion of the anode 12, and by an anode pin 13, which is one of the stem pins 6, being fixed by welding to the anode connecting tab 12*a*, the anode pin 13 is electrically connected to the anode 12. And when predetermined voltages are applied to the electron multiplier unit 9 and the anode 12 by means of the stem pins 6 connected to an unillustrated power supply circuit, the photoelectric surface 4 and the focusing electrode 11 are set to the same potential and the potentials of the respective dynodes 10 are set so as to increase in the order of layering from the upper stage to the lower stage. The anode 12 is set to a higher potential than the dynode 10*b* of the final stage. Though in the present embodiment, the final dynode 10*b* is directly set and fixed on the upper surface of the stem 5, an arrangement, wherein the final dynode 10*b* is supported, for example, by a supporting member installed on the upper surface of the stem 5 and a space is interposed between final dynode 10*b* and the upper surface of the stem 5, is also possible.

With the photomultiplier 1, arranged as described above, when light (hv) is made incident on the photoelectric surface 4 from the light receiving plate 3 side, the light at the photoelectric surface 4 is photoelectrically converted and electrons (e−) are emitted into the sealed container 8. The emitted electrons are focused by the focusing electrode 11 onto the first dynode 10*a* of the electron multiplier unit 9. The electrons are then multiplied successively inside the electron multiplier unit 9 and a set of secondary electrons are emitted from final dynode 10*b*. This group of secondary electrons is guided to the anode 12 and output to the exterior via the anode pin 13, which is connected to the anode 12.

The arrangement of the abovementioned stem 5 shall now be described in further detail. Here, with the stem 5, the side, which is to be put in a vacuum state upon forming of the sealed container 8 of photomultiplier, shall be referred to as the "inner side" (upper side).

As shown in FIG. 3, the stem 5 has a two-layer structure that is formed by the base member 14 and an upper holding member 15, which is joined to the upper side (inner side) of the base member 14, and the abovementioned ring-like side tube 7 is fixed to the side surface. In the present embodiment, the stem 5 is fixed to the ring-like side tube 7 by joining the side surface of the base member 14, which makes up the stem 5, with the inner wall surface of the ring-like side tube 7. Here, although the lower (outer) surface of the base member 14 protrudes below the lower end of the ring-like side tube 7, the position of fixing of the stem 5 with respect to the ring-like side tube 7 is not restricted to that described above.

Figure 4:
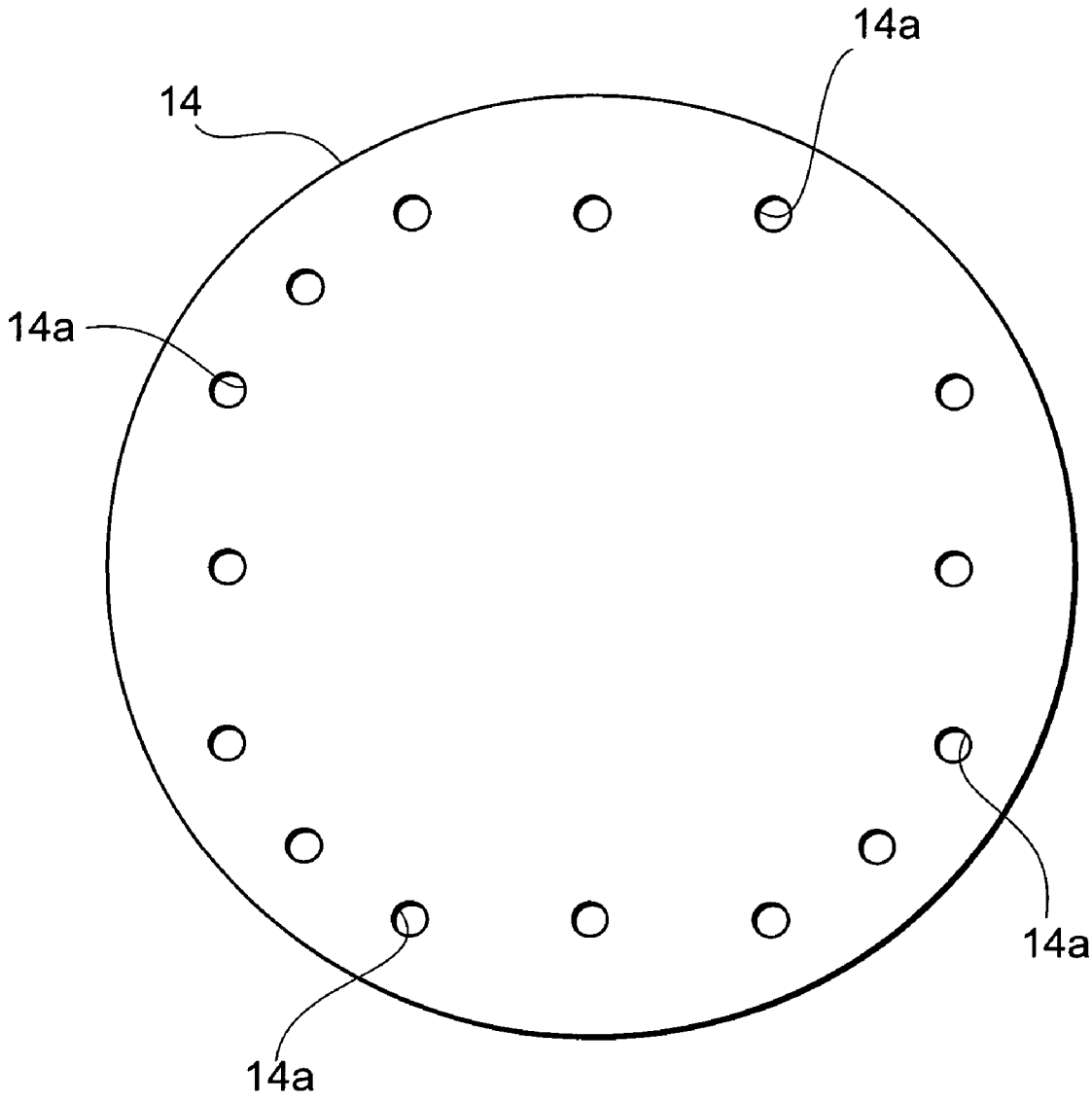
FIG. 4 is a plan view of a base member.
Figure 5:
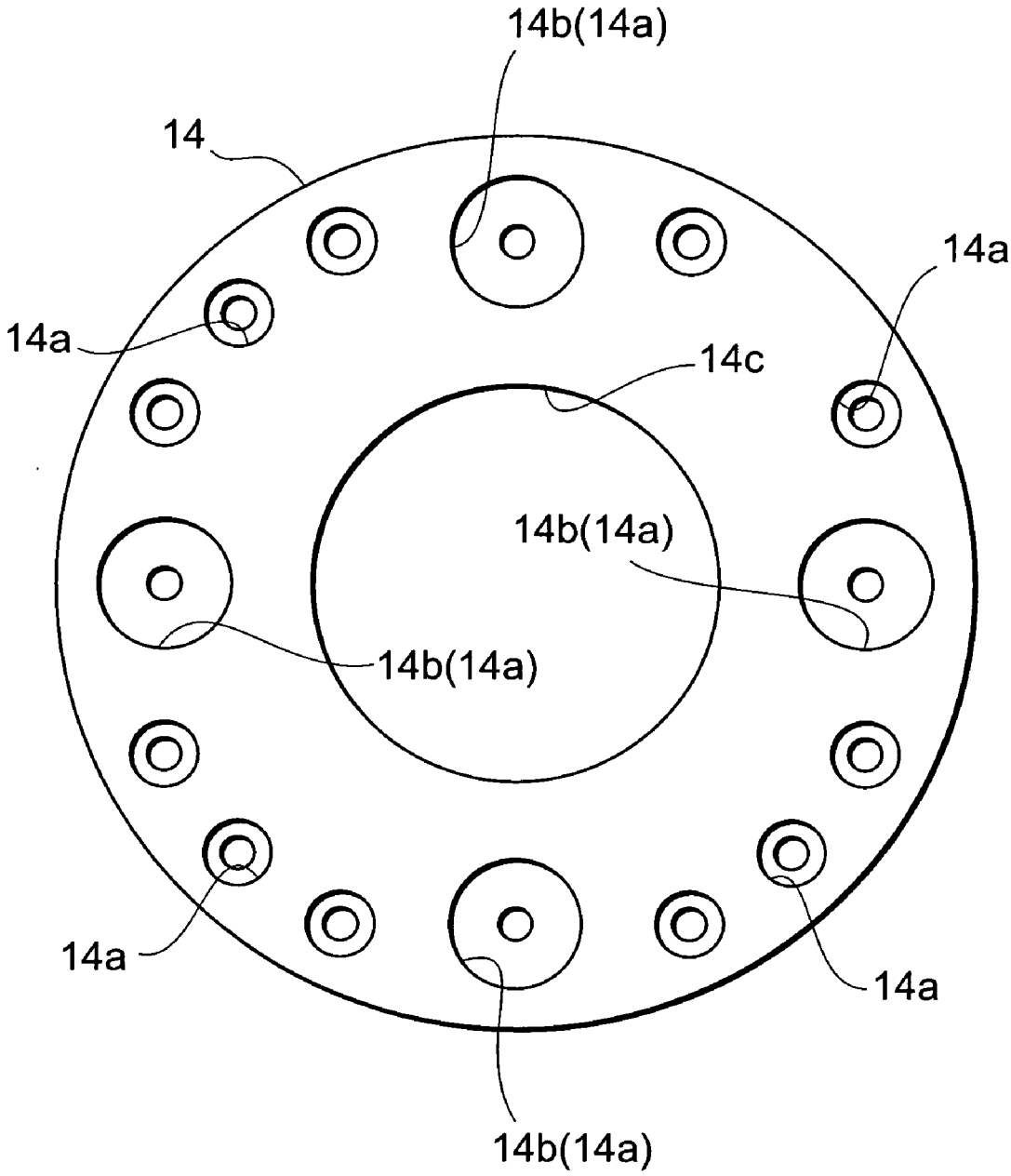
FIG. 5 is a bottom view of the base member.

The base member 14 is a disk-like member formed of an insulating glass having, for example, covar as the main component and having a melting point of approximately 780 degrees, and is made black in color to a degree to which light will not be transmitted into the sealed container 8 from the lower surface side. The base member 14 has, along outer peripheral portions of the base member 14, a plurality (15) of openings 14*a*, with each of which the diameter of the upper half is made substantially equal to the outer diameter of the stem pin 6 as shown in FIG. 4 and the diameter of the lower half is made larger than the outer diameter of the stem pin 6 as shown in FIG. 5. Of the openings 14*a* of the base member 14, the openings of at least two predetermined locations are arranged as large-diameter openings 14*b*, with each of which the outer diameter of the lower half is made larger than the outer diameter of the lower half of each of the other openings 14*a* in order to enable the entry of a positioning jig 18 (to be described below). With this base member 14, the large-diameter openings 14*b* are positioned at four locations separated at a phase angle of 90 degrees, including the location of the opening 14*a* into which the anode pin 13 is inserted. Furthermore, a circular base member seep recess 14*c* (see FIG. 7), serving as a base member seep portion into which the base member 14 seeps upon melting, is formed at a central portion of the lower portion of the base member 14.

Figure 6:
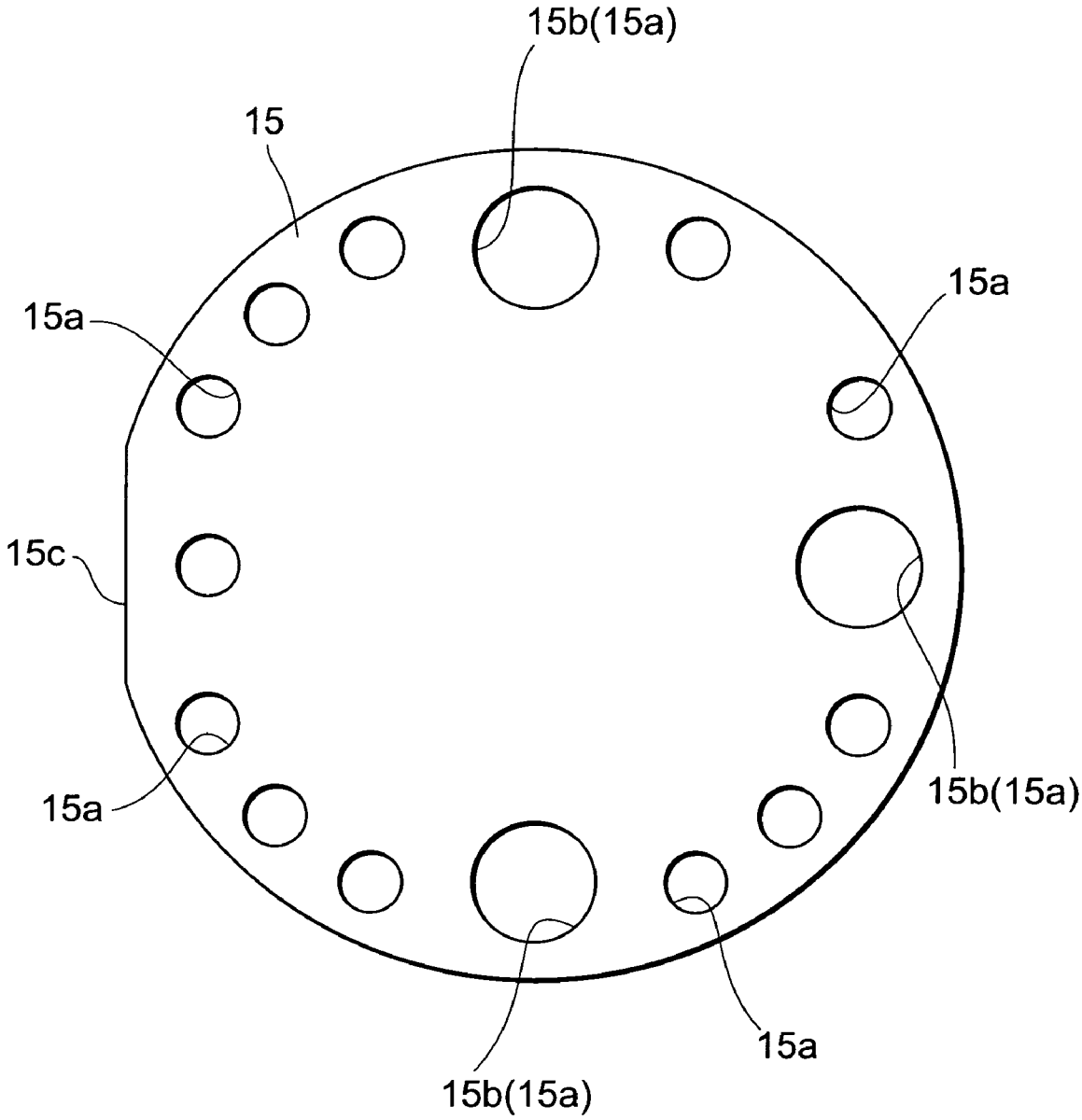
FIG. 6 is a plan view of a lower holding member.

The upper holding member 15 is a disk-like member, formed of insulating glass that has been made to have a higher melting point than the base member 14, that is for example, a melting point of approximately 1100 degrees by, for example, the addition of an alumina-based powder to covar, and is made black in color in order to effectively absorb light emitted inside the sealed container 8. Also as shown in FIG. 6, the upper holding member 15 has a plurality (15) of the openings 15*a*, positioned in the same manner as those of the base member 14. Each opening 15*a* is made larger in diameter than the openings 14*a* formed in the base member 14, and furthermore, among the openings 15*a*, the openings of at least two predetermined locations are arranged as large-diameter openings 15*b*, which are made larger in diameter than the other openings 15*a* in order to enable the entry of a positioning jig 18 into the base member 14. In the upper holding member 15, the large-diameter openings 15*b* are positioned at three locations, other than the location of the opening 15*a* into which the anode pin 13 is passed, which are separated by a phase angle of 90 degrees, and the large-diameter openings 14*b* at the three locations besides the large-diameter opening 14*b*, through which the anode pin 13 is passed, are positioned coaxial to the large-diameter openings 15*b* of the upper holding member 15. Also with the upper holding member 15, a peripheral portion near the opening 15*a*, through which the anode pin 13 is passed, is made as the chamfered shape 15*c*.

As shown in FIG. 3, the base member 14 and the upper holding member 15 are overlapped in a state in which the axial center positions of the respective openings 14*a* and 15*a* and the large-diameter openings 14*b* and 15*b* are matched and are joined by fusing by the melting of the base member 14 in the state in which the stem pins 6 are inserted through the respective openings 14*a* and 15*a*. More specifically, the upper holding member 15 is joined in close contact with the upper surface of the base member 14, the respective stem pins 6 are inserted through the lower halves of the respective openings 14*a* of the base member 14 and the respective openings 15*a* of the upper holding member 15 so that recesses 5*a*, having the base member 14 as the bottom surfaces, are formed along the full circumferences of the portions of both the upper (inner) surface and the lower (outer) surface of the stem 5 through which the respective stem pins 6 pass, and the respective stem pins 6 are joined in close contact with the base member 14 at the bottom surfaces of the recesses 5*a*.

An example of manufacturing the stem 5, arranged in the above-described manner shall now be described with reference to FIG. 7 and FIG. 8.

Figure 7:
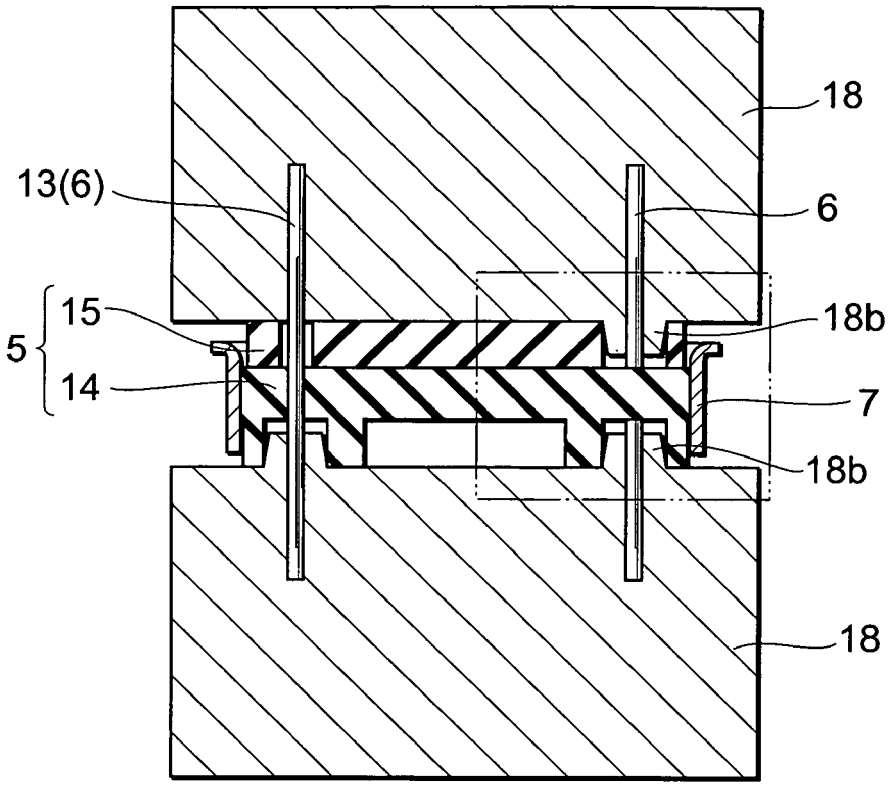
FIG. 7 shows an example of manufacturing a stem, with (a) being a sectional side view and (b) being an enlarged view of the principal portions of the stem in a state prior to sintering.
Figure 7:
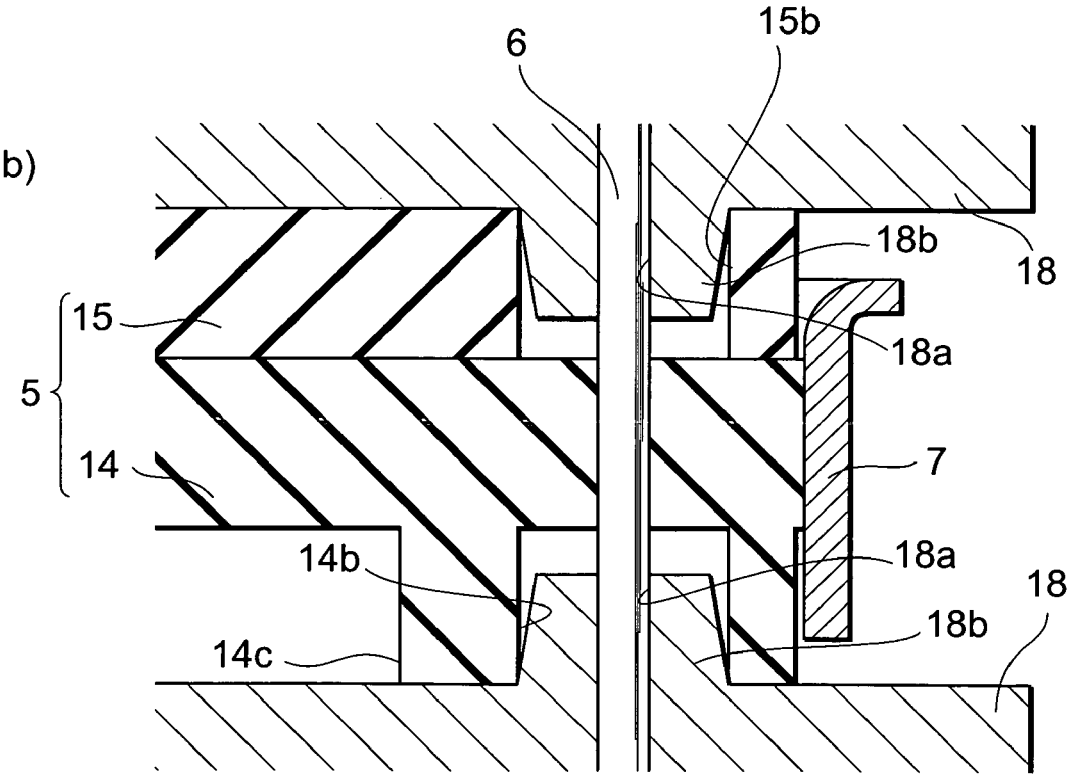
Figure 8:
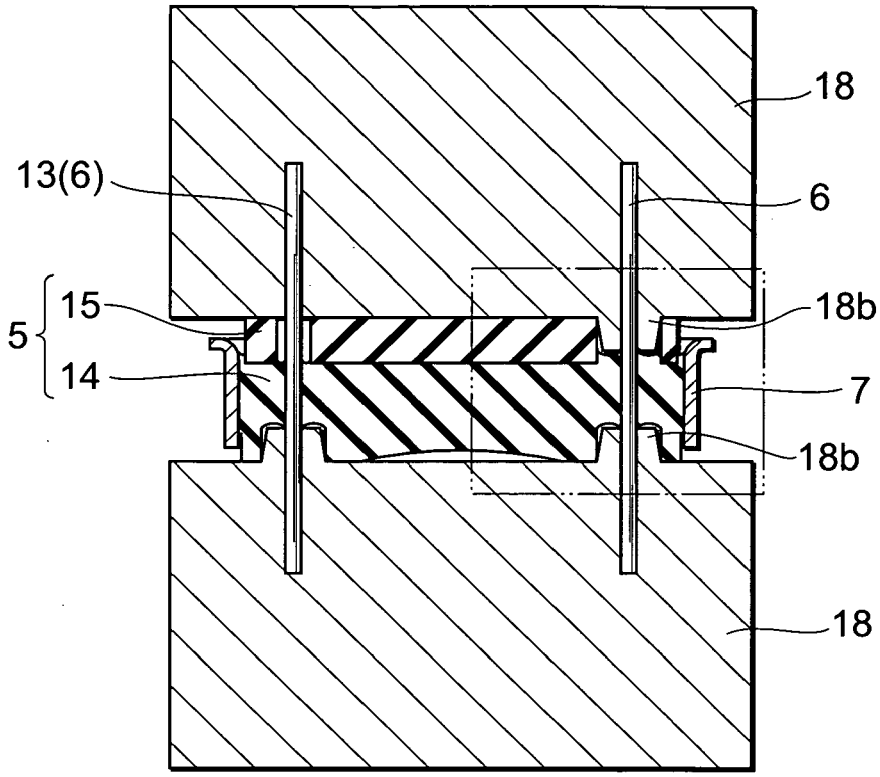
FIG. 8 shows the example of manufacturing the stem, with (a) being a sectional side view and (b) being an enlarged view of the principal portions of the stem in a state after sintering.
Figure 8:
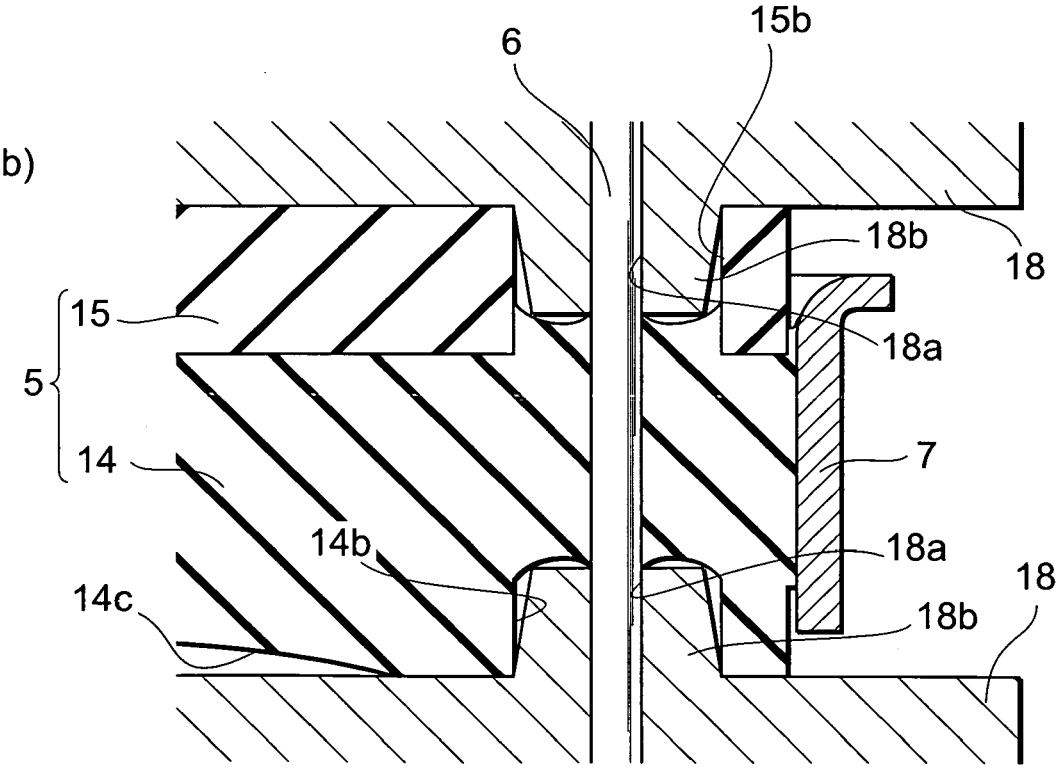

In manufacturing the stem 5, a pair of the positioning jigs 18, which sandwich and hold the base member 14, the upper holding member 15, and the respective stem pins 6 in positioned states, are used as shown in FIG. 7(*a*) and FIG. 7(*b*).

The positioning jigs 18 are block-like members formed, for example, of highly heat resistant carbon with a melting point of no less than 1100 degrees, and at one side of each, the insertion holes 18*a*, into and by which stem pins 6 are inserted and supported, are formed in correspondence with the positions of the respective stem pins 6. At the peripheries of the openings of the insertion holes 18*a*, which, among the insertion holes 18*a*, correspond to the large-diameter opening 14*b* of the base member 14 and the large-diameter opening 15*b* of the upper holding member 15, are formed substantially cylindrical protrusions 18*b*, which position the upper holding member 15 with respect to the base member 14 by entering inside the large-diameter openings 15*b* and thereby secure the concentricities of the respective stem pins 6 that pass through the base member 14 with respect to the respective openings 15*a*.

In using the positioning jigs 18 to set the stem 5, first, one positioning jig 18 (the jig at the lower side of the figure) is set, with the protrusions 18*b* facing upward, on a working surface (not shown) and stem pins 6 are respectively inserted and fixed respectively in the insertion holes 18*a* of this positioning jig 18. The base member 14 is then set on the positioning jig 18 by making the protrusions 18*b* of the positioning jig 18 enter the large-diameter openings 14*b* while passing the respective stem pins 6, fixed to the positioning jig 18, through the openings 14*a*. Furthermore, while roughly matching the axial center positions of the respective openings 15*a* and the respective large-diameter openings 15*b* to the respective openings 14*a* and the large-diameter openings 14*b* of the base member 14, stem pins 6 are passed through the respective openings 15*a* and the respective large-diameter openings 15*b* to overlap the upper holding member 15 onto the base member 14, and thereafter, the ring-like side tube 7 is fitted onto the base member 14. Lastly, the other positioning jig 18 (the jig at the upper side of the figure) is set on the upper holding member 15 by making the protrusions 18*b* enter into the large-diameter openings 15*b* of the upper holding member 15 while inserting the respective stem pins 6, protruding outward from the upper holding member 15, into the insertion holes 18*a*. The setting of the stem 5 is thereby completed. The ring-like side tube 7 and the respective stem pins 6 that are set are subject to a surface oxidizing process in advance in order to heighten the property of fusion with the base member 14.

The stem 5, which is set thus, is then loaded inside an electric oven (not shown) along with the positioning jigs 18 and sintered at a temperature of approximately 850 to 900 degrees (a temperature that is higher than the melting point of the base member 14 but lower than the melting point of the upper holding member 15) while pressurizing the stem 5 sandwichingly by the positioning jigs 18. In this sintering process, just the base member 14, having a melting point of approximately 780 degrees, melts, and the base member 14 and the upper holding member 15, the base member 14 and the respective stem pins 6, and the base member 14 and the ring-like side tube 7 become fused as shown in FIG. 8(*a*) and FIG. 8(*b*). Here, although in order to achieve improved close adhesion with the other components, the volume of the base member 14 is adjusted to be somewhat high, the positioning of the base member 14 in the height direction within the large-diameter openings 14*b* and 15*b* is achieved by means of the end faces of the protrusions 18*b* of the positioning jigs 18 and the excess volume of the molten base member 14 is made to escape into the base member seep recess 14*c* of the base member 14 as shown in FIG. 8(*b*). When the sintering process ends, the stem 5 is taken out from the electric oven and the upper and lower positioning jigs 18 are removed, thereby completing the manufacture of the stem 5.

With such a method of manufacturing the stem 5, since the base member 14 can be readily positioned with respect to the upper holding member 15 by making the protrusions 18*b* of the positioning jigs 18 enter into the large-diameter openings 14*b* of the base member 14 and the large-diameter openings 15*b* of the upper holding member 15, the manufacturing process is simplified and the manufacturing cost can be reduced. Furthermore, the concentricities of the respective stem pins 6 and the respective openings 15*a* are secured by the positioning jigs 18. By then fixing the dynodes 10, focusing electrode 11, and the anode 12, which are layered on the inner (upper) surface of the stem 5 of the stem assembly thus obtained, by wielding the dynode connecting tabs 10*a*, the anode connecting tabs 12*a*, and protruding tabs 11*a*, provided on focusing electrode 11, respectively to the corresponding stem pins 6, and fixing by welding and thereby assembling together the side tube 2, to which the light receiving plate 3 is fixed, onto the ring-like side tube 7 in a vacuum state, the photomultiplier 1 of the so-called head-on type, which is shown in FIG. 1 to FIG. 3, is obtained.

With this arrangement of the photomultiplier 1, the base member 14, through which stem pins 6 are passed and on the upper surface (inner surface) of which the upper holding member 15 is joined, is joined to stem pins 6 and the upper holding member 15 by fusion by the melting of the base member 14, a volume of the base member 14 escapes satisfactorily upon melting into the base member seep recess 14*c*, and the stem 5 is arranged as a two-layer arrangement formed by the holding of the base member 14 by the upper holding member 15. The positional precision, flatness, and levelness of especially the upper surface (inner surface) of the stem 5 are thus improved in comparison to the conventional arrangement wherein the stem 5 is a single layer of glass material and this is melted to insertingly mount stem pins 6. Consequently with the photomultiplier 1, the positional precision of the interval between the photoelectric surface 4 and the electron multiplier unit 9, which is installed on the upper surface (inner surface) of the stem 5, and the seating property of the electron multiplier unit 9 are improved, thus enabling photoelectric conversion efficiency and other characteristics to be obtained satisfactorily. In regard to improving the positional precision, flatness, and levelness of the upper surface of the stem 5, the material of the upper holding member 15 may be a metal.

Furthermore with the photomultiplier 1, in addition to the full circumferences of the stem pin 6 passing portions of the stem 5 being arranged as the recesses 5*a* having the base member 14 as the bottom surfaces, the upper holding member 15, which is the member at the upper side of the base member 14, has an insulating property. Also with the upper holding member 15, the peripheral portion near the anode pin 13 is arranged as the chamfered shape 15*c* (see FIG. 6). The actions of this arrangement shall now be described in detail using FIG. 9 and FIG. 10.

Figure 9:
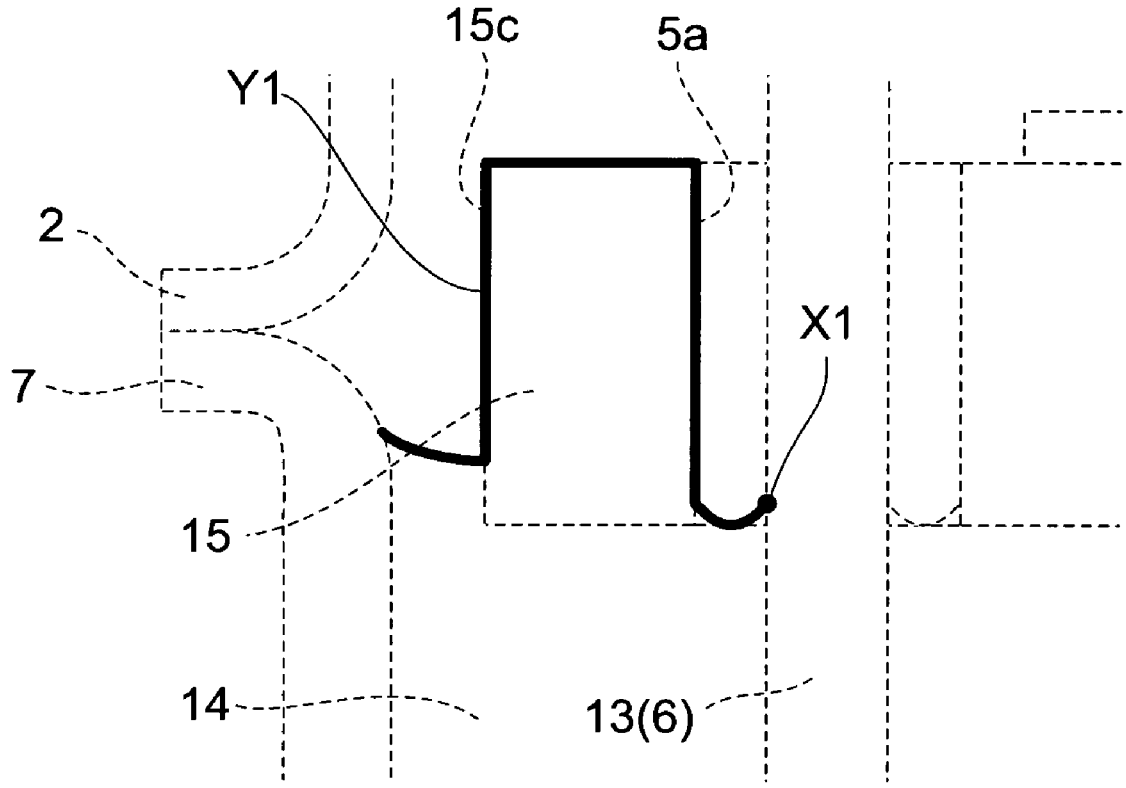
FIG. 9 is an enlarged view of the principal portions near an anode pin and shows a triple junction and the creeping distance of the photomultiplier shown in FIG. 3.
Figure 10:
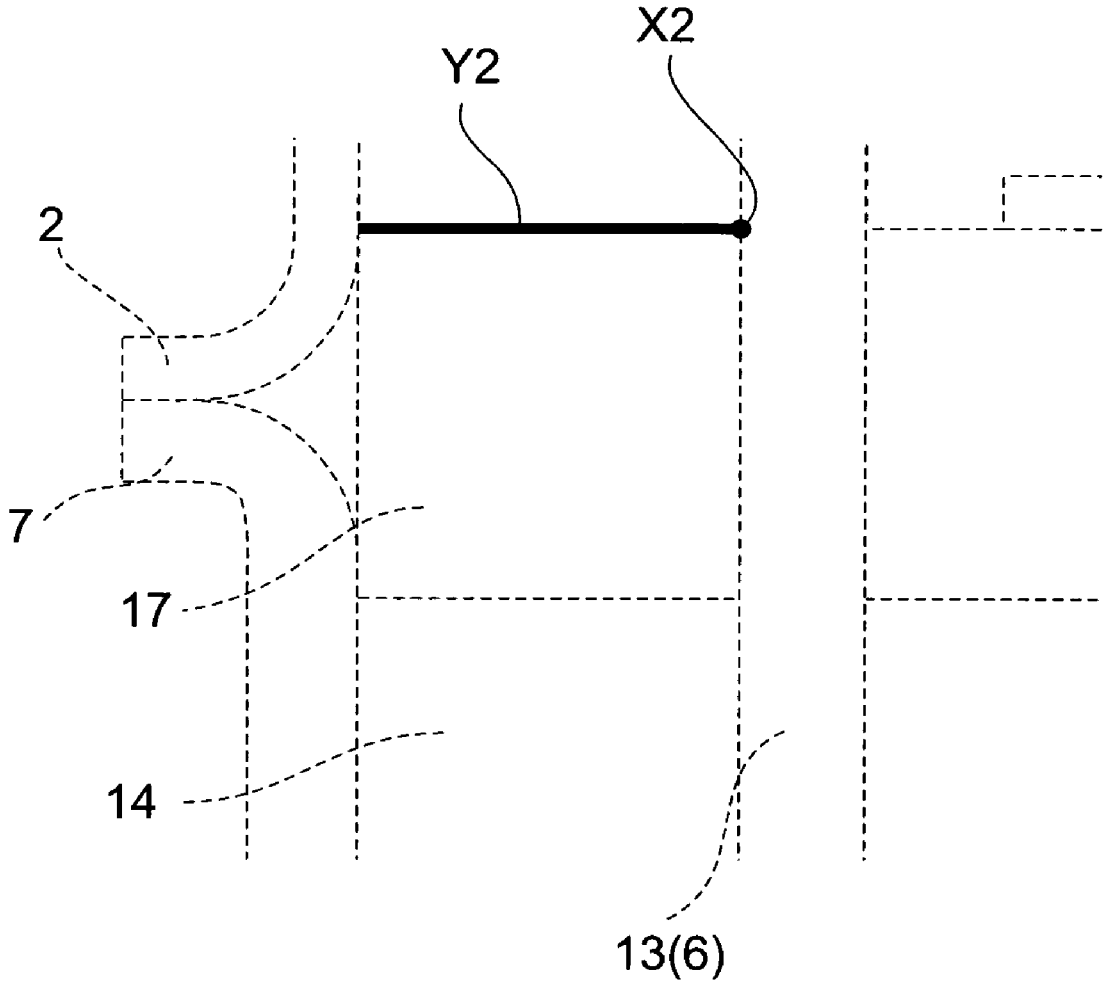
FIG. 10 is an enlarged view of the principal portions near an anode pin and shows a triple junction and the creeping distance of a comparative example.

FIG. 9 is an enlarged sectional view of the principal portions near the anode pin 13 of the present embodiment and FIG. 10 is an enlarged sectional view of the principal portions near the anode pin 13 of a comparative example. In the comparative example, the recesses 5*a* are not formed at portions of the stem 5 through which stem pins 6, including the anode pin 13, are passed, and an upper holding member 17, in which a chamfered shape 15*c* is not formed near the anode pin 13, is used. For the sake of description, the respective members are indicated by broken lines.

As shown in FIG. 9, with the present embodiment, since the full circumferences of the portions of the stem 5, through which the stem pins 6, including the anode pin 13, pass, are formed as recesses 5*a*, having the base member 14 as the bottom surfaces, triple junctions X1, at which any of the conductive stem pins 6, including the anode pin 13, insulating the base member 14, joined to the stem pins 6 including the anode pin 13, and vacuum intersect, are positioned at peripheral portions of the junctions of the bottom surface of the recess 5*a* of the stem 5 with the stem pins 6 including the anode pin 13 and are put in concealed-like states inside the recesses 5*a*. By thus concealing triple junctions X1 inside the recesses 5*a*, the occurrence of creeping discharge is restrained and the voltage endurance of the photomultiplier 1 is improved in comparison to the case where the triple junctions are put in bare states on the upper surface of the upper holding member 17 as is the case with triple junctions X2 of the comparative example shown in FIG. 10. In regard to the concealing of triple junctions X1 by the recesses 5*a*, the upper holding member 15, which is a member positioned above the base member 14, may be conductive.

Also, the creeping distance Y1 along insulators from a triple junction X1 to the ring-like side tube 7 is elongated by an amount corresponding to the height of the recess 5*a* in comparison to the creeping distance Y2 along insulators from a triple junction X2 to the side tube 2 in the comparative example shown in FIG. 10. By thus elongating the creeping distance Y1, the occurrence of creeping discharge is restrained further and the voltage endurance of the photomultiplier 1 is improved further. By the forming of the recess 5*a*, the creeping distances along insulators between the stem pins 6 are elongated at the same time and the voltage endurance of the photomultiplier 1 is thereby improved further. Furthermore in regard to the vicinity of the anode pin 13, since the creeping distance Y1 is elongated especially by the distance along the chamfered shape 15*c* of the upper holding member 15, dielectric breakdown and current leakage caused by creeping discharge in the vicinity of the anode pin 13 are prevented more definitely and the mixing of noise into the electrical signal taken out from the anode pin 13 is prevented.

Since the concentricities of the respective stem pins 6 and the respective openings 15*a* of the upper holding member 15 and the respective openings 16*a* of the lower holding member 16 are secured by the positioning jigs 18, the stem pins 6 can be prevented from approaching the inner wall surfaces of the openings 16*a* and 16*a*. Triple junctions X1 can thus be concealed definitely inside the recesses Sa and the voltage endurance of the photomultiplier 1 is thus secured further.

With the photomultiplier 1, since the full circumferences of the stem pin 6 passing portions of the upper (inner) surface and lower (outer) surface of the stem 5 are arranged as the recesses 5*a* having the base member 14 as the bottom surfaces, the base member 14 is joined to stem pins 6 at gradual angles (substantially right angles), and since even when a bending force acts on stem pins 6, stem pins 6 will contact the peripheral portions at the open sides of the recesses 5*a* and this prevents further bending of stem pins 6, cracks are prevented from being formed at both sides of the portions at which stem pins 6 are joined to the base member 14, and the airtightness and good appearance of the sealed container 8 are thus secured.

This invention is not restricted to the above-described embodiment. For example, although with the above-described embodiment, the base member seep recess 14*c* is provided as the base member seep portion only at a lower portion of the base member 14, it is sufficient that such a base member seep portion be provided in at least one of the base member 14 and the upper holding member 15 and, for example, the base member seep portion may be provided as a base member seep opening in the upper holding member 15 or the base member seep recess 14*c* may be provided in the base member 14 and a base member seep opening may be provided in the upper holding member 15.

Figure 11:
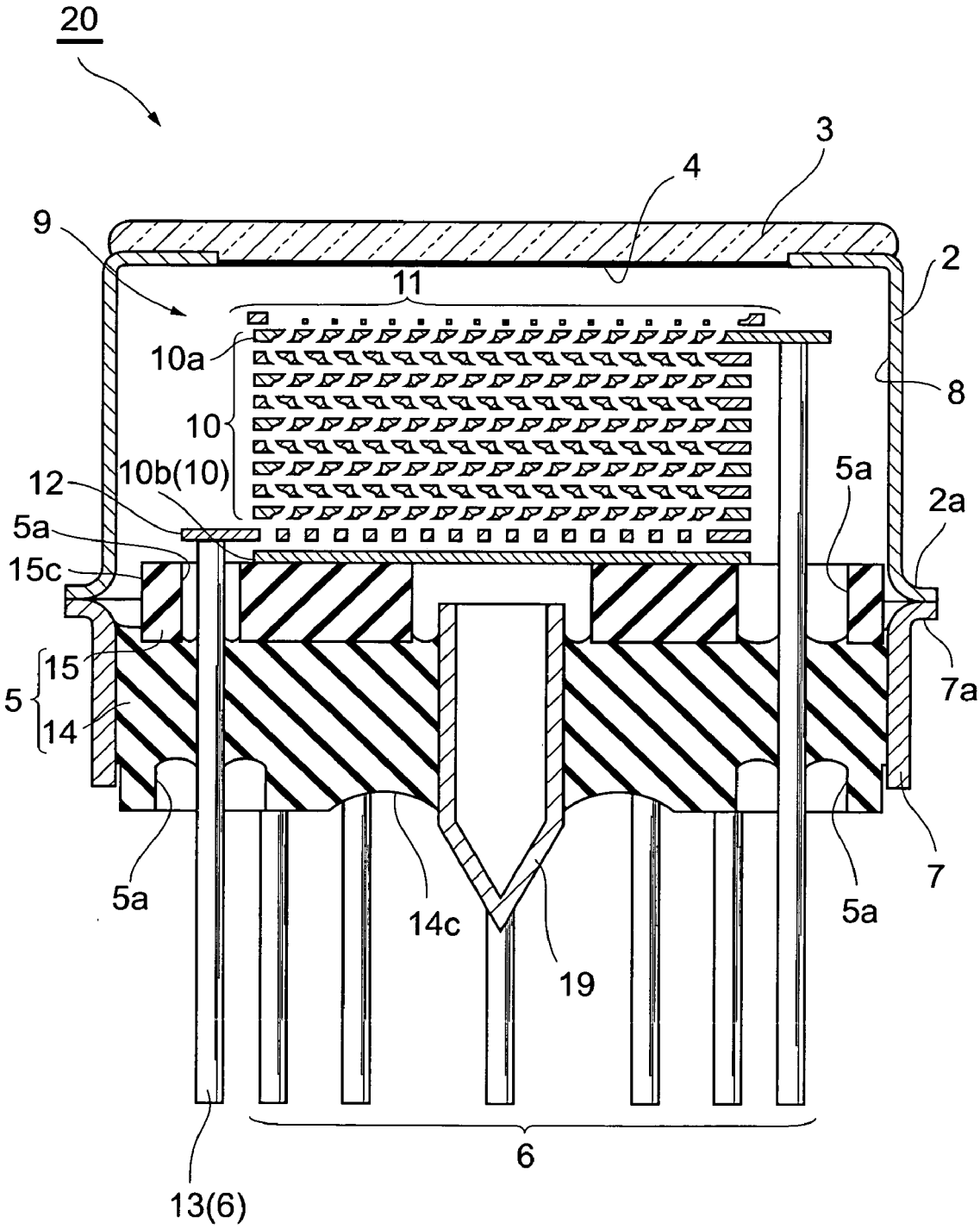
FIG. 11 is a sectional side view of a photomultiplier of a modification example.
Figure 12:
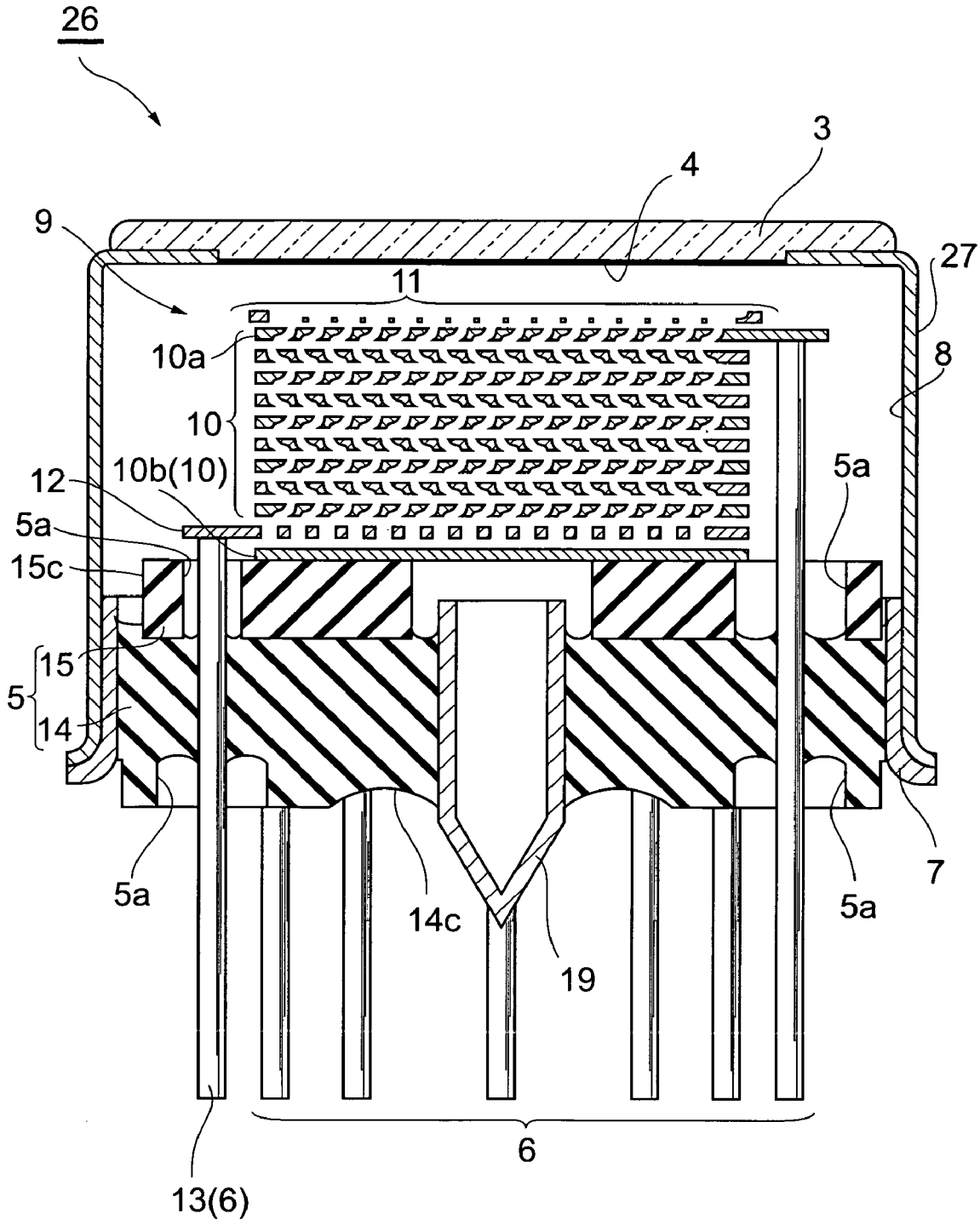
FIG. 12 is a sectional side view of a photomultiplier of another modification example.

As a modification example of the present embodiment, a photomultiplier tube 20, having a metal exhaust tube 19 disposed at a central portion of the stem 5 as shown in FIG. 11, may be employed. This exhaust tube 19 can be used to exhaust air by a vacuum pump (not shown), etc., and put the interior of the sealed container 8 in a vacuum state after completion of assembly of the photomultiplier 20. As yet another modification example, a photomultiplier 26 may be employed that has an arrangement, wherein a side tube 27, which is longer in length than the side tube 2, is fitted to the ring-like side tube 7, provided with a flange portion at its lower end, and the flange portions of the side tubes are fixed together by welding as shown in FIG. 12.

Figure 13:
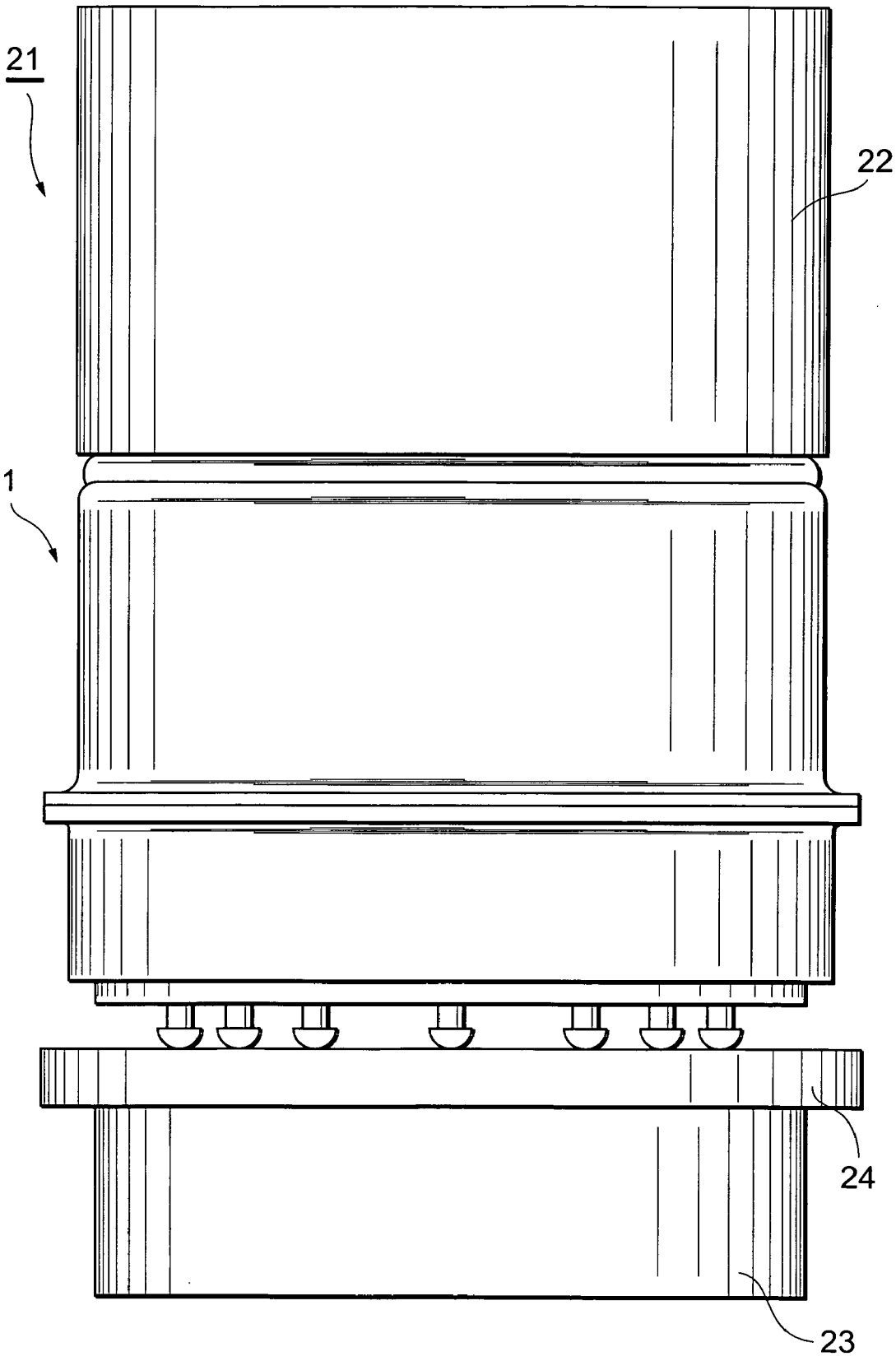
FIG. 13 is a sectional side view of an example of a radiation detector.
Figure 14:
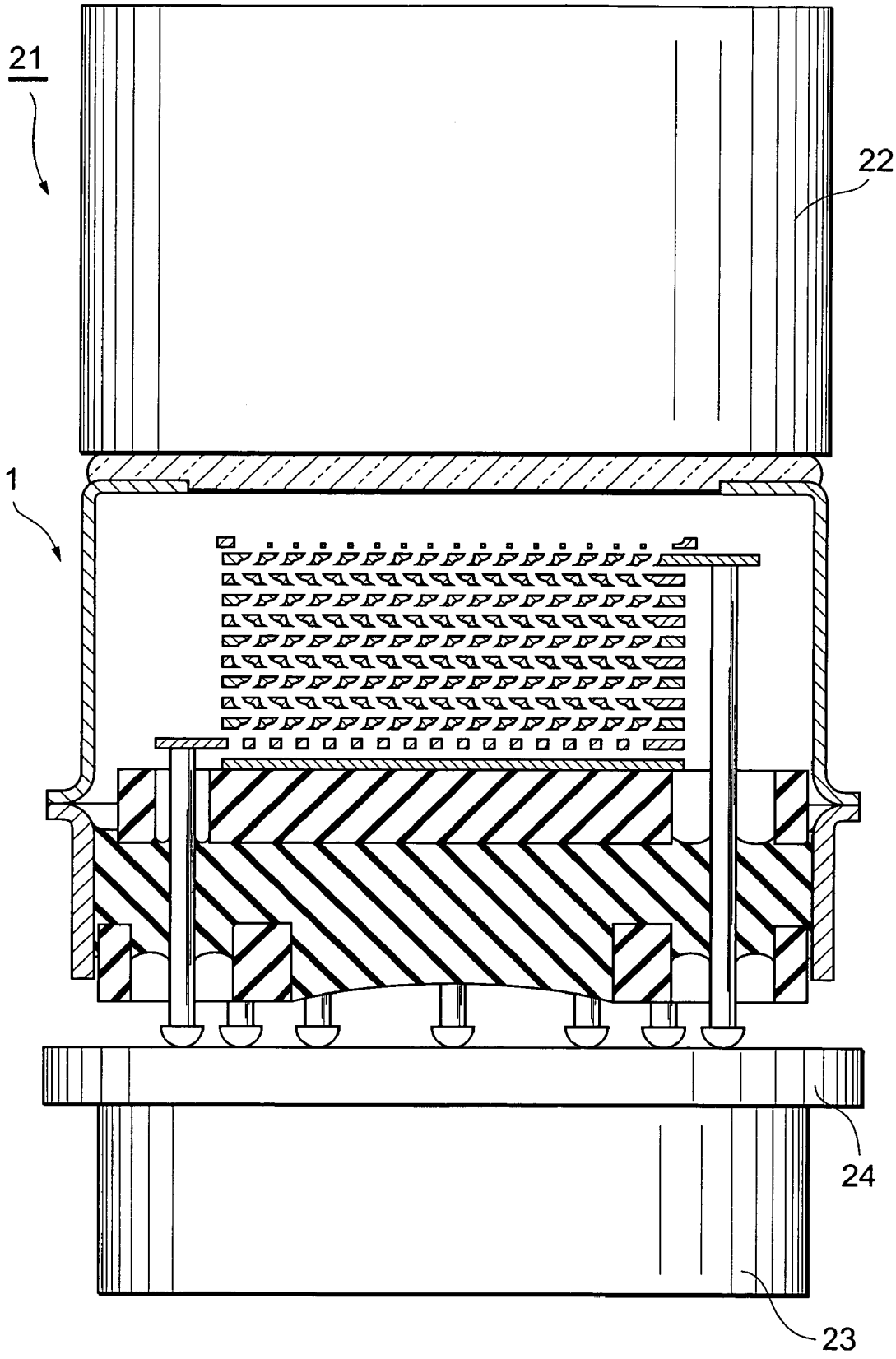
FIG. 14 is a sectional view of the principal portions of the radiation detector shown in FIG. 13.
Figure 15:
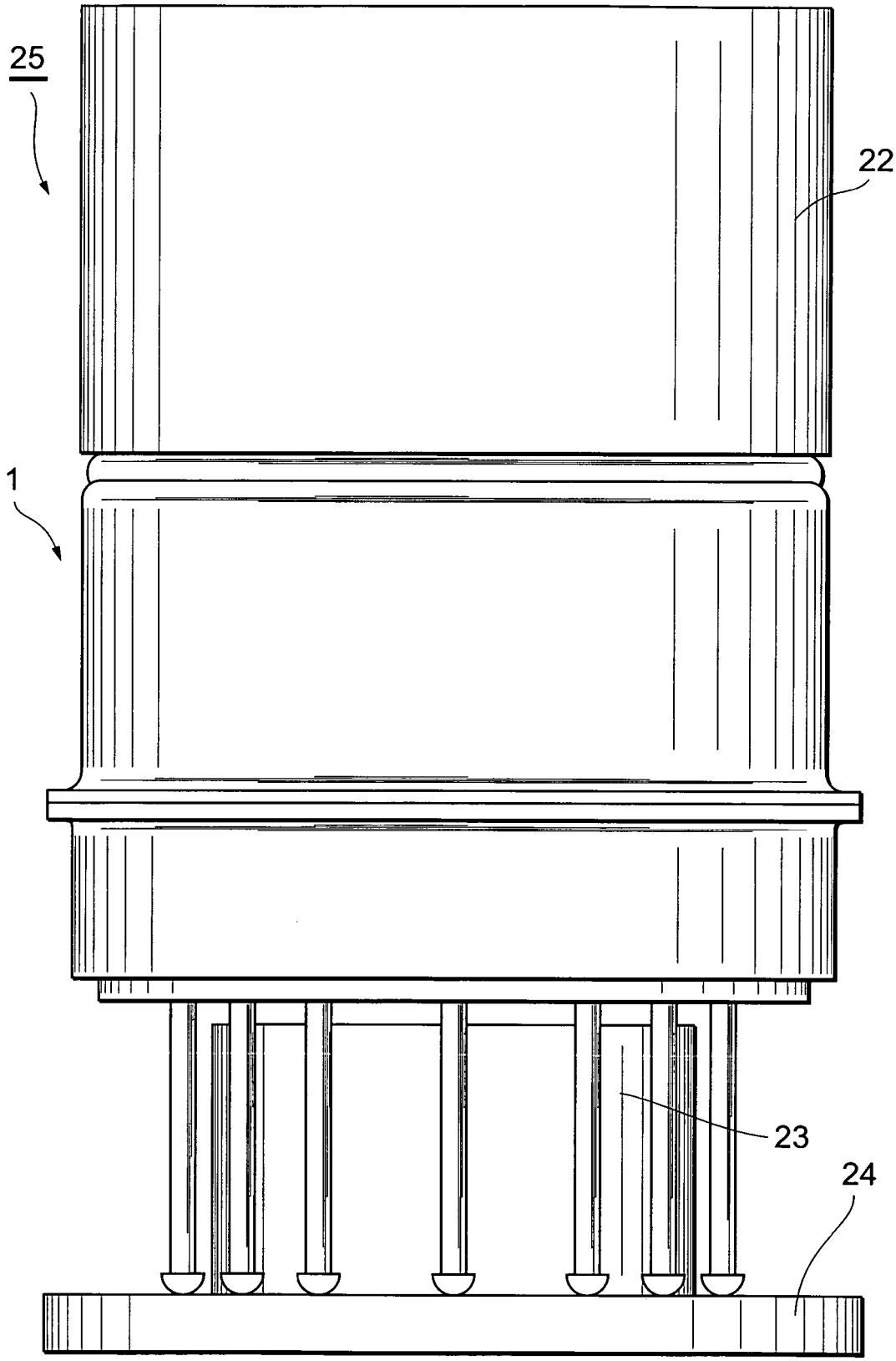
FIG. 15 is a sectional side view of another example of a radiation detector.
Figure 16:
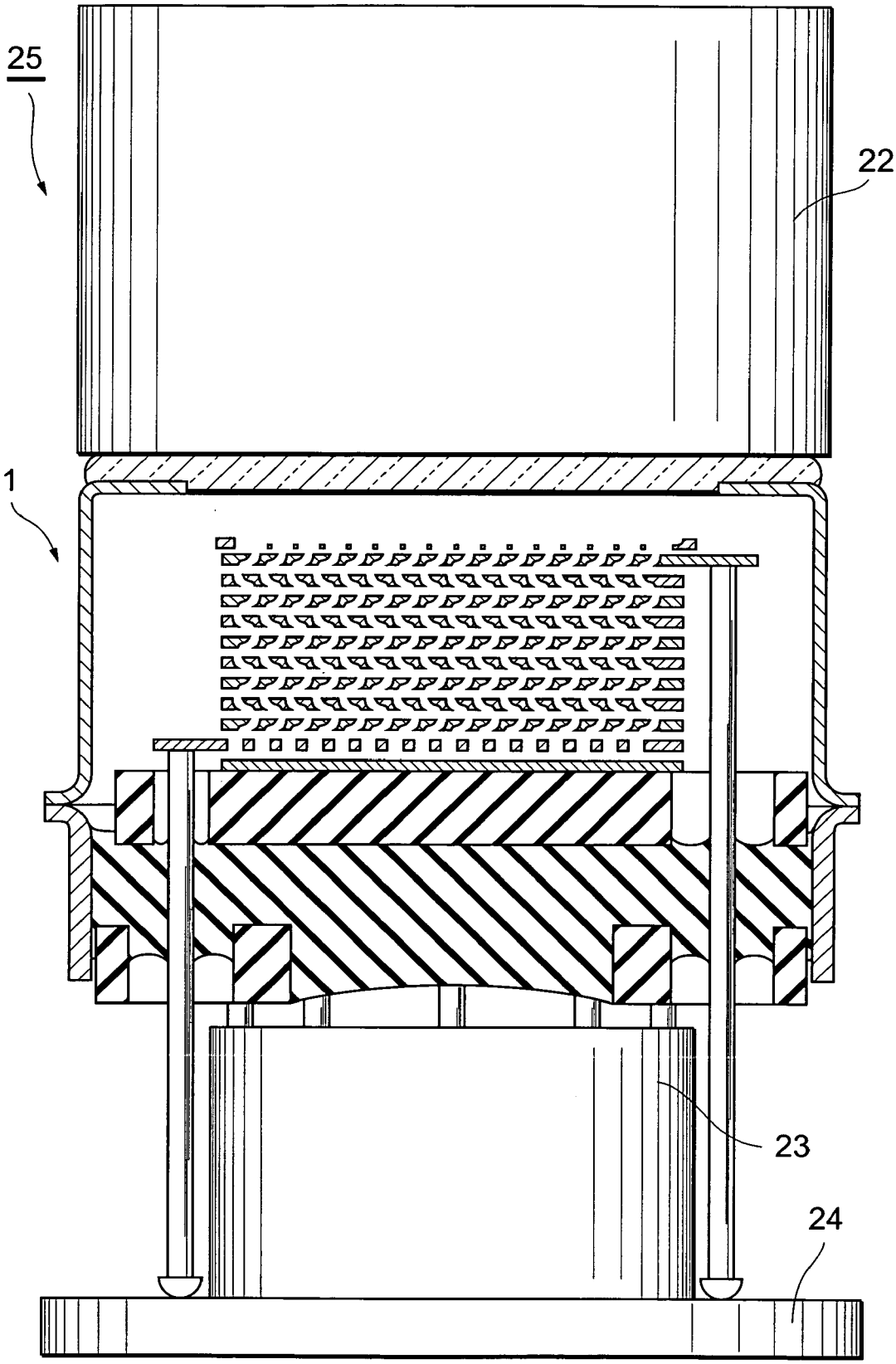
FIG. 16 is a sectional view of the principal portions of the radiation detector shown in FIG. 15.

Examples of a radiation detector equipped with the photomultiplier 1 shown in FIG. 1 to FIG. 3 shall now be described. With a radiation detector 21 of the example shown in FIG. 13 and FIG. 14, a scintillator 22, which converts radiation into light and emits the light, is installed at the outer side of the light receiving plate 3 of the photomultiplier 1, and the photomultiplier 1 is mounted onto a circuit board 24, having a processing circuit 23 at the lower surface side. With a radiation detector 25 of another example shown in FIG. 15 and FIG. 16, processing circuit 23 is installed above circuit board 24, and the photomultiplier 1 is mounted onto circuit board 24 in a manner such that stem pins 6 surround processing circuit 23. By these arrangements, the radiation detectors 21 and 25, which exhibit the above-described actions and effects and are especially suitable for surface mounting, can be provided.

Figure 17:
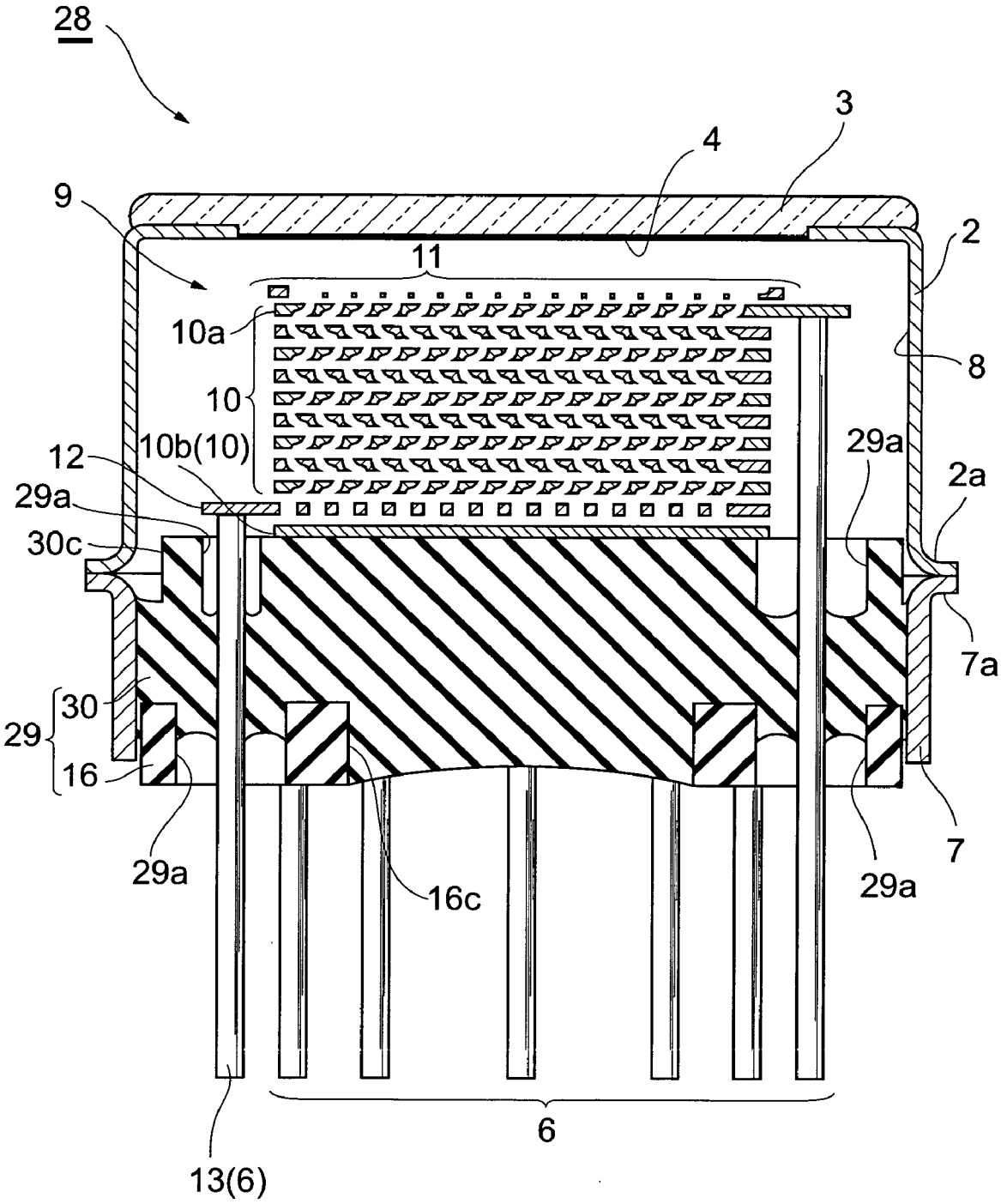
FIG. 17 is a sectional side view of a photomultiplier of another modification example.

As yet another modification example of the present embodiment, a stem with a two-layer structure may be arranged by joining a holding member to the lower surface (outer surface) of a base member. As shown in FIG. 17, a photomultiplier 28 of this other modification example has a stem 29 arranged as a two-layer structure of a disk-like base member 30, of the same quality as the base member 14, and the lower holding member 16, joined to the lower side (inner side) of the base member 30, and thereby differs from the photomultiplier 1, shown in FIG. 1 to FIG. 3, with which the stem 5 is arranged as a two-layer structure of the base member 14 and the upper holding member 15, which holds the base member 14 from the upper side (inner side).

Figure 18:
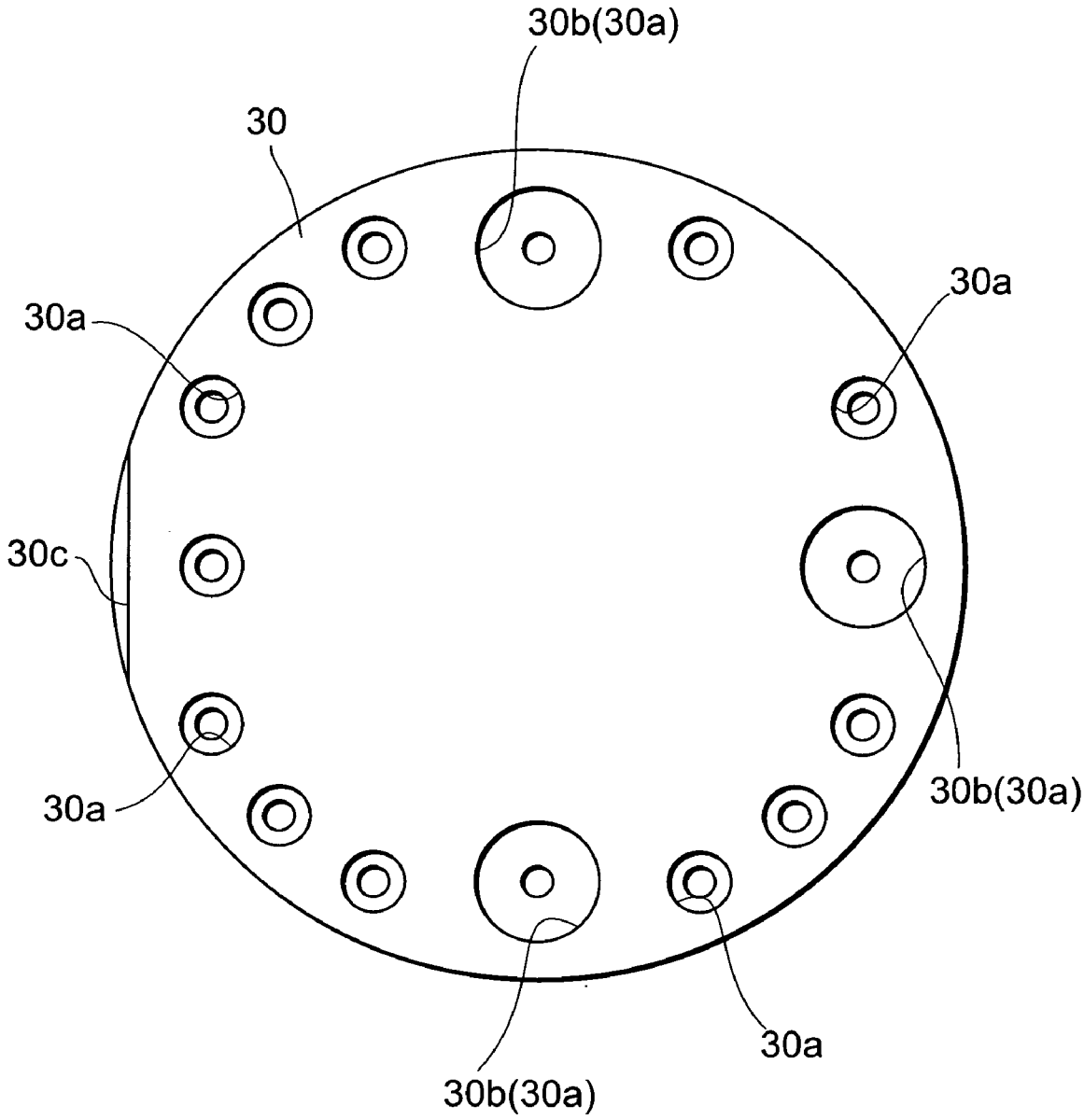
FIG. 18 is a plan view of a base member of the photomultiplier shown in FIG. 17.
Figure 19:
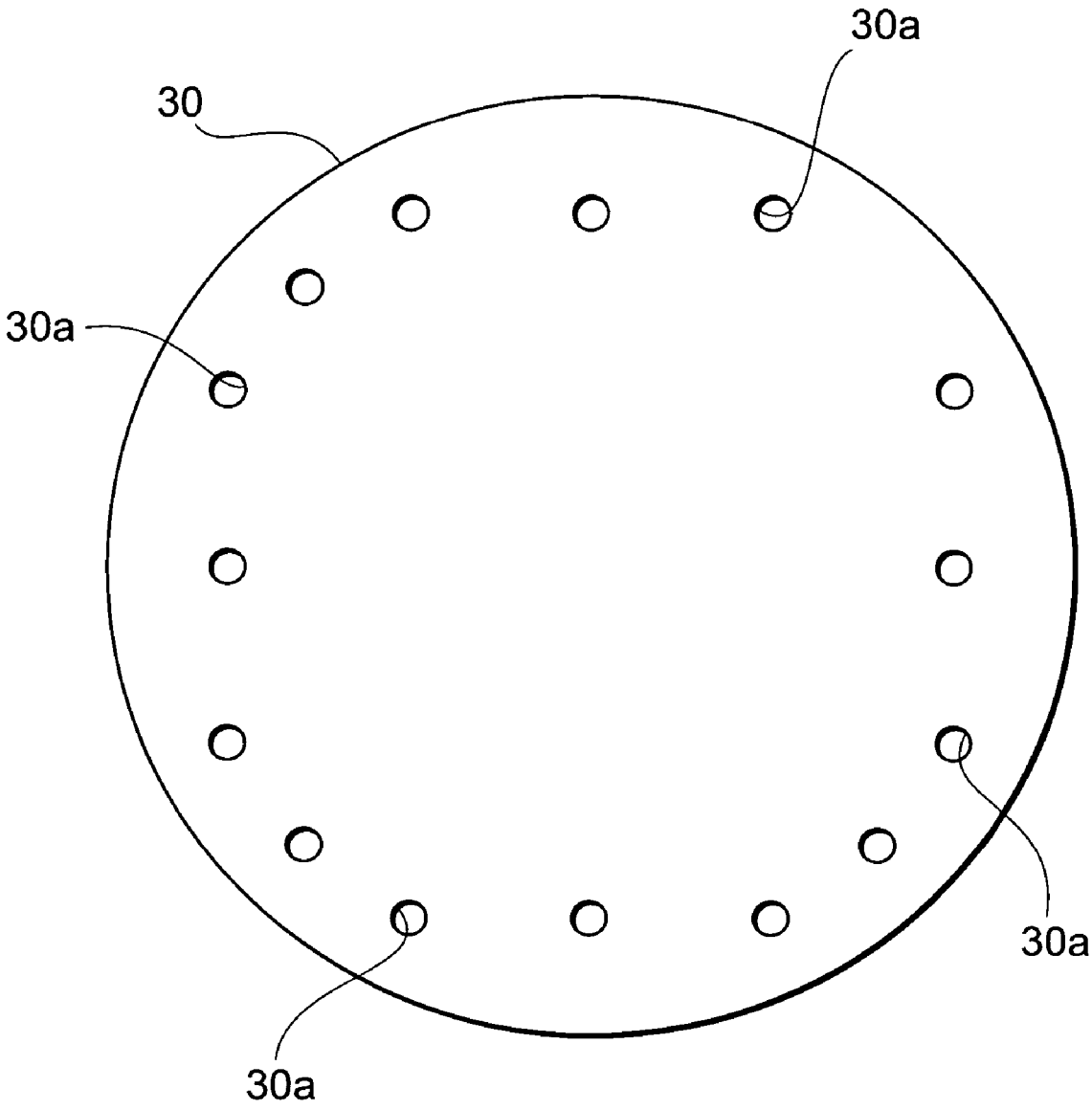
FIG. 19 is a bottom view of a base member of the photomultiplier shown in FIG. 17.

The base member 30 of this photomultiplier 28 has, along outer peripheral portions of the base member 30, a plurality (15) of openings 30*a*, with each of which the diameter of the lower half is made substantially equal to the outer diameter of each stem pin 6 as shown in FIG. 19 and the diameter of the upper half is made larger than the outer diameter of each stem pin 6 as shown in FIG. 18. Of the openings 30*a* of the base member 30, those of three predetermined locations, other than that of the opening 30*a* through which the anode pin 13 passes, are arranged as the large-diameter openings 30*b*, with each of which the outer diameter of the upper half is made larger than the outer diameter of the upper half of each of the other openings 30*a* in order to enable the entry of the positioning jig 18. Furthermore, a peripheral portion of the base member 30 at the upper side near the opening 30*a*, through with the anode pin 13 passes, is arranged as a chamfered shape 30*c*.

Figure 20:
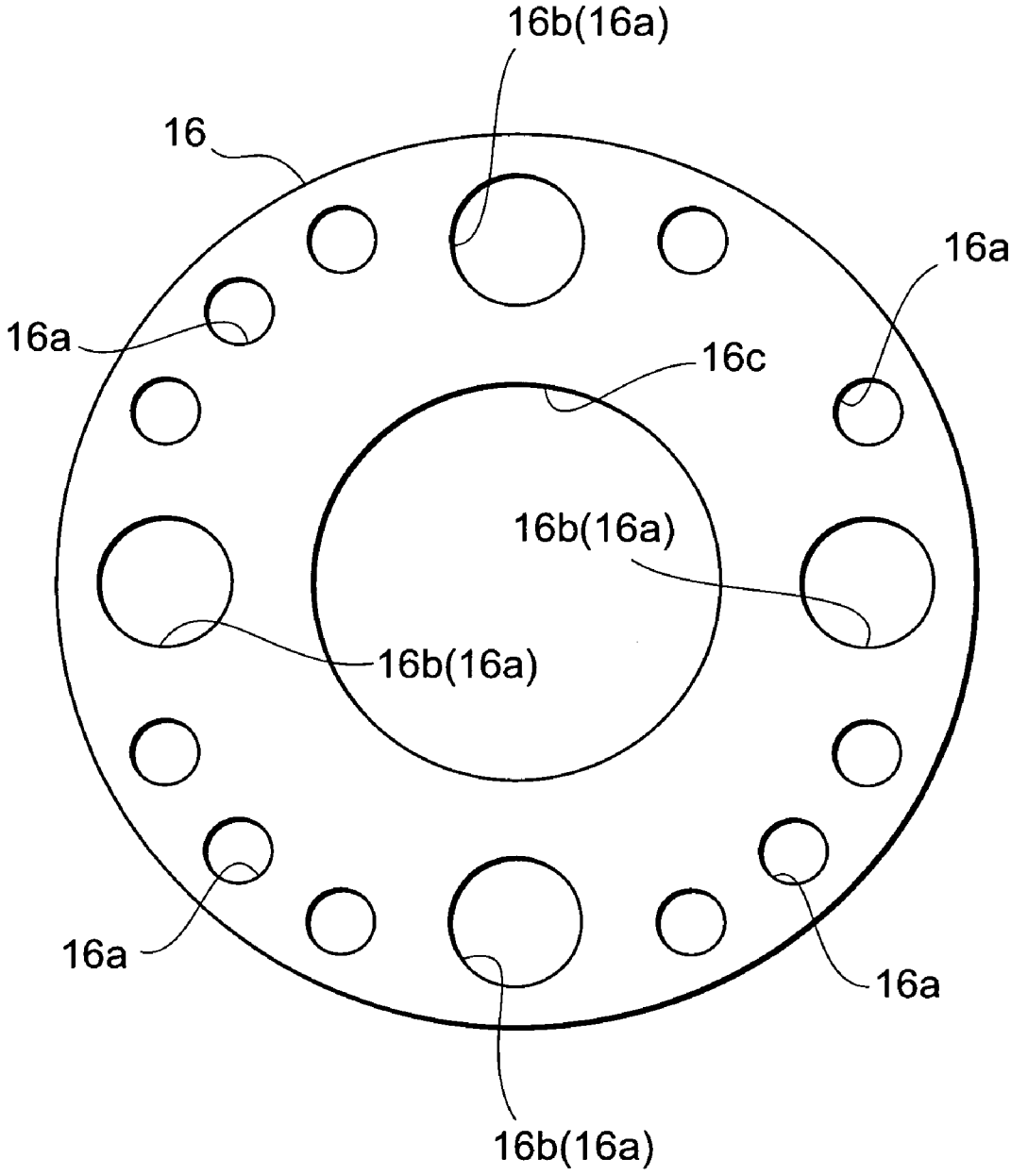
FIG. 20 is a plan view of a lower holding member of the photomultiplier shown in FIG. 17.

As with the upper holding member 15, the lower holding member 16 is a disk-like member, formed of insulating glass that has been made to have a melting point of approximately 1100 degrees and thus to be higher than the melting point of the base member 30 by, for example, the addition of an alumina-based powder to covar and, by the difference in the composition of the alumina-based powder added, is made to exhibit a white color and have a higher physical strength than the base member 30. Also as shown in FIG. 20, the lower holding member 16 has a plurality of openings 16*a* formed in the same manner as the upper holding member 15, and among the openings 16*a*, the openings of at least two predetermined locations are arranged as the large-diameter openings 16*b* to enable the entry of the positioning jigs 18. In the lower holding member 16, the large-diameter openings 16*b* are positioned at four locations separated by a phase angle of 90 degrees, including that of opening 16*a* into which the anode pin 13 is inserted, and the large-diameter openings 16*b* at the three locations besides the opening 16*b*, through which the anode pin 13 passes, are positioned coaxial to the large-diameter openings 30*b* of the base member 30. Furthermore, as a base member seep portion into which the base member 30 seeps upon melting, a circular base member seep opening 16*c* is opened at a central portion of the lower holding member 16.

As shown in FIG. 17, the base member 30 and the upper holding member 15 are overlapped in a state, in which the axial center positions of the respective openings 30*a* and 16*a* and the large-diameter openings 30*b* and 16*b* are matched, and are joined by fusing by the melting of the base member 30 in the state in which the stem pins 6 are inserted through the respective openings 30*a* and 16*a* and the respective large-diameter openings 30*b* and 16*b*. More specifically, the lower holding member 16 is joined in close contact with the lower surface of the base member 30, the respective stem pins 6 are inserted through the upper halves of the respective openings 30*a* of the base member 30 and the respective openings 16*a* of the lower holding member 16 so that recesses 29*a*, having the base member 30 as the bottom surfaces, are formed along the full circumferences of the portions of both the upper (inner) surface and the lower (outer) surface of the stem 29 through which the respective stem pins 6 pass, and the respective stem pins 6 are joined in close contact with the base member 30 at the bottom surfaces of the recesses 29*a*.

Figure 21:
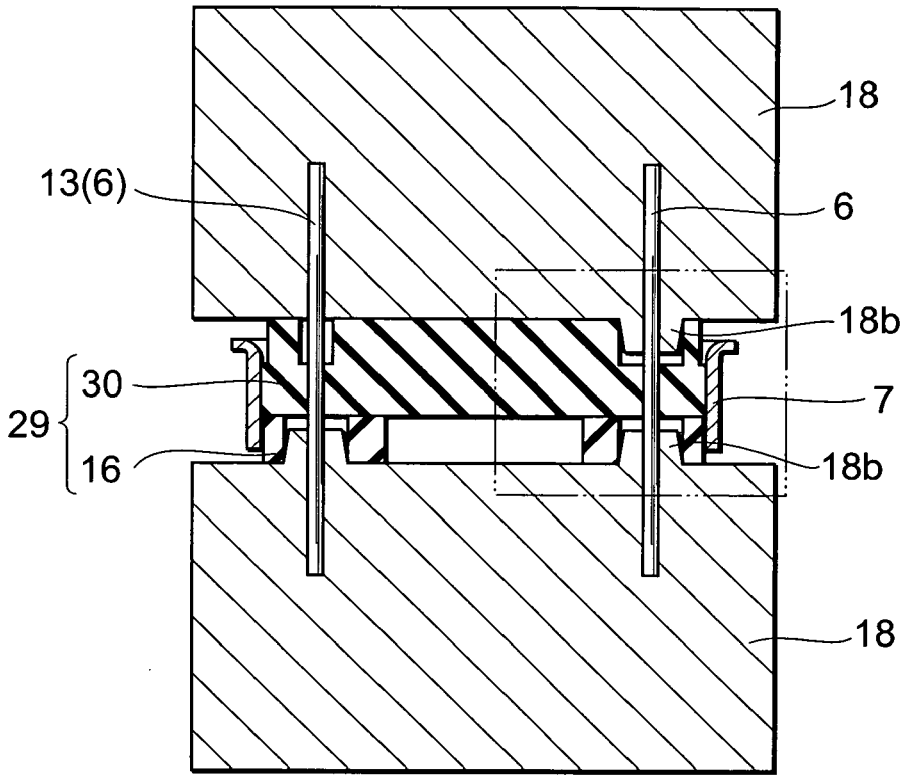
FIG. 21 shows an example of manufacturing a stem of the photomultiplier shown in FIG. 17, with (a) being a sectional side view and (b) being an enlarged view of the principal portions of the stem in a state prior to sintering.
Figure 21:
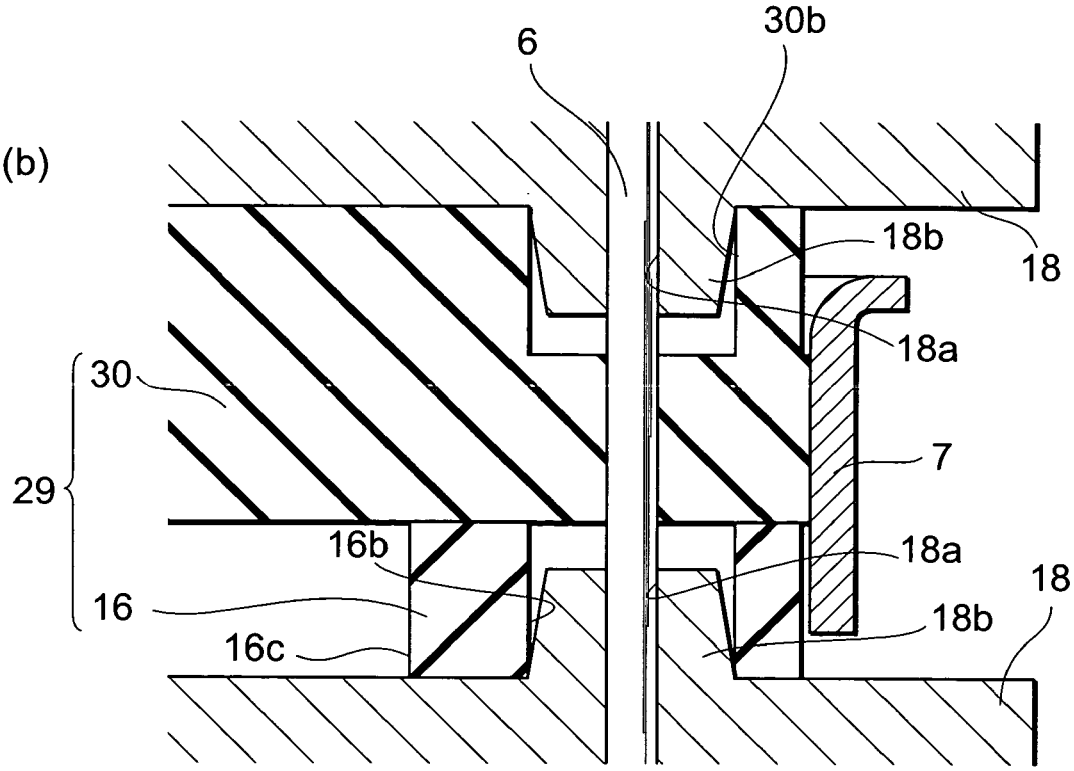

The same method as that for the stem 5 of the above-described embodiment can be employed to manufacture such a stem 29 as well. Specifically as shown in FIG. 21(*a*) and FIG. 21(*b*), first, one positioning jig 18 (the jig at the lower side of the figures) is set, with the protrusions 18*b* facing upward, on a working surface (not shown) and stem pins 6 are respectively inserted and fixed in the insertion holes 18*a* of this positioning jig 18, and then the lower holding member 16 is set on the positioning jig 18 by making the protrusions 18*b* of the positioning jig 18 enter the large-diameter openings 16*b* while passing the respective stem pins 6, fixed to the positioning jig 18, through the openings 16*a*. Furthermore, while roughly matching the axial center positions of the respective openings 30*a* and the respective large-diameter openings 30*b* to the respective openings 16*a* and the large-diameter openings 16*b* of the lower holding member 16, stem pins 6 are passed through the respective openings 30*a* and the respective large-diameter openings 30*b* and the base member 30 is overlapped onto the lower holding member 16, and thereafter, the ring-like side tube 7 is fitted onto the base member 30. Lastly, the other positioning jig 18 (the jig at the upper side of the figures) is set on the base member 30 by making the protrusions 18*b* enter into the large-diameter openings 30*b* of the base member 30 while inserting the respective stem pins 6, protruding outward from the base member 30, into the insertion holes 18*a*. The setting of stem 29 is thereby completed. As with the above-described embodiment, the ring-like side tube 7 and the respective stem pins 6 that are set are subject to a surface oxidizing process in advance in order to heighten the property of fusion with the base member 30.

Figure 22:
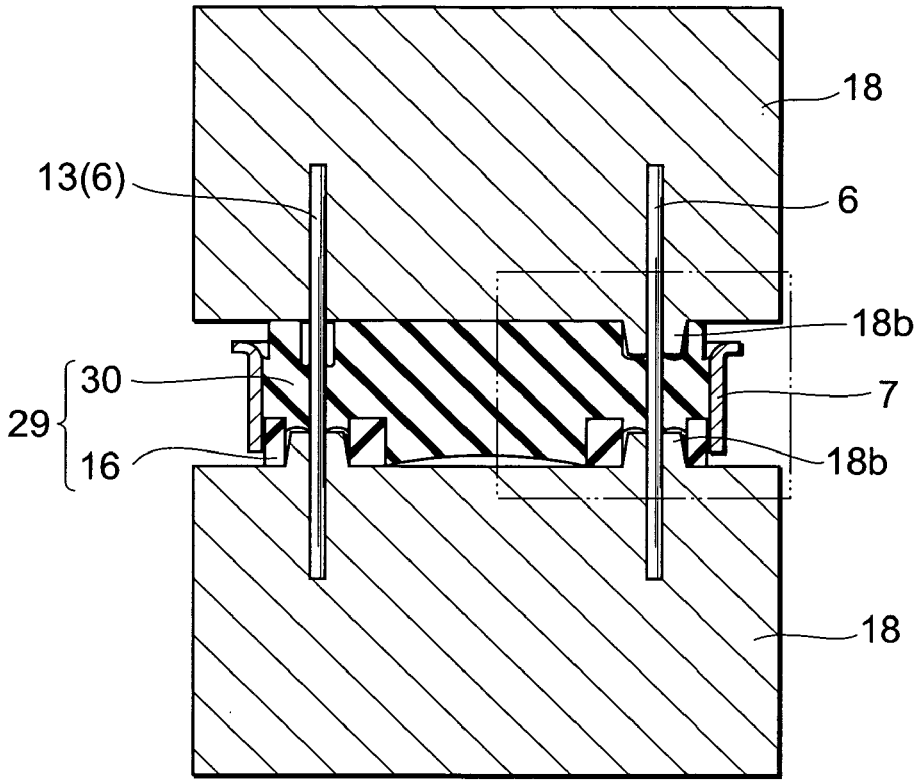
FIG. 22 shows the example of manufacturing the stem of the photomultiplier shown in FIG. 17, with (a) being a sectional side view and (b) being an enlarged view of the principal portions of the stem in a state after sintering.
Figure 22:
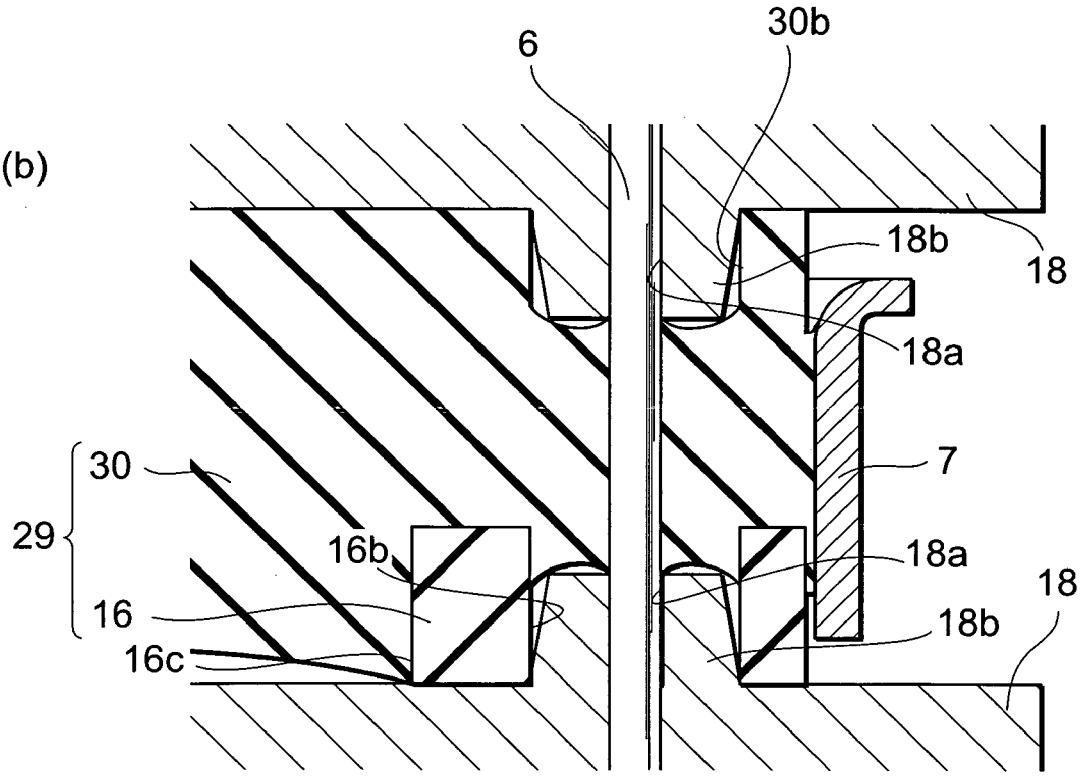

Stem 29, which is set thus, is then loaded inside an electric oven and subject to a sintering process under the same conditions as those mentioned above. In this sintering process, the base member 30 and the lower holding member 16, the base member 30 and the respective stem pins 6, and the base member 30 and the ring-like side tube 7 become fused by the melting of the base member 30 as shown in FIG. 22(*a*) and FIG. 22(*b*). Here, the positioning of the base member 30 in the height direction within the large-diameter openings 30*b* and 16*b* is achieved by means of the end faces of the protrusions 18*b* of the positioning jigs 18, and the excess volume of the molten base member 30 is made to escape into a base member seep recess 16*c* as shown in FIG. 22(*b*). When the sintering process ends, stem 29 is taken out from the electric oven and the upper and lower positioning jigs 18 are removed, thereby completing the manufacture of stem 29.

With such a method of manufacturing stem 29, since, as with the above-described embodiment, the base member 30 can be readily positioned with respect to the lower holding member 16 by means of the positioning jigs 18, the manufacturing process is simplified and the manufacturing cost can be reduced. Furthermore, the concentricities of the respective stem pins 6 and the respective openings 16*a* are secured by the positioning jigs 18. By then fixing the dynodes 10, focusing electrode 11, and the anode 12, which are layered on the inner (upper) surface of stem 29 of the stem assembly thus obtained, by wielding the dynode connecting tabs 10*a*, the anode connecting tabs 12*a*, and protruding tabs 11*a*, provided on focusing electrode 11, respectively to the corresponding stem pins 6, and fixing by welding and thereby assembling together the side tube 2, to which the light receiving plate 3 is fixed, onto the ring-like side tube 7 in a vacuum state, the head-on photomultiplier 28 shown in FIG. 17 is obtained.

With the photomultiplier 28 arranged in the above-described manner, the base member 30, through which the stem pins 6 are passed and the lower surface (outer surface) of which is held by the lower holding member 16, is joined to the stem pins 6 and the lower holding member 16 by fusion by the melting of the base member 30, a volume of the base member 30 escapes satisfactorily upon melting into the base member seep opening 16*c*, and the stem 29 is arranged as a two-layer arrangement formed by the holding of the base member 30 by the lower holding member 16. The positional precision, flatness, and levelness of especially the lower surface (outer surface) of the stem 5 are thus improved in comparison to the conventional arrangement wherein the stem 29 is a single layer of glass material, and this is melted to insertingly mount stem pins 6. Consequently, the dimensional precision of the total length of the photomultiplier 28 and the mounting property regarding surface mounting of the photomultiplier 28 are improved.

Also, since the full circumferences of the stem pin 6 passing portions are arranged as recesses 29*a*, having the base member 30 as the bottom surfaces, the triple junctions are concealed inside the recesses 29a and the predetermined voltage endurance is secured in the photomultiplier 28 as well. Furthermore, since the recesses 29*a* are formed thus and the base member 30, which makes up the recesses 29*a*, has an insulating property in itself, the creeping distances are elongated. Furthermore, since with the base member 30, which is an insulator, the peripheral portion of the upper side near the anode pin 13 is arranged as the chamfered shape 30*c* (see FIG. 18), the mixing of noise into the electrical signal taken out from the anode pin 13 is prevented.

With the photomultiplier 28, by the upper halves of the respective openings 30*a* of the base member 30 and the respective openings 16*a* of the lower holding member 16, the full circumferences of the stem pin 6 passing portions of the upper (inner) surface and the lower (outer) surface of the stem 29 are arranged as described above as the recesses 29*a*, having the base member 30 as the bottom surfaces. Cracks are thus prevented from being formed at both sides of the portions at which the base member 30 is joined to the stem pins 6, and airtightness and good appearance of the sealed container 8 are thus secured.

Also, although with the present modification example, the base member seep opening 16*c* is provided as the base member seep portion in just the lower holding member 16, it is sufficient that such a base member seep portion be provided in at least one of the base member 30 and the lower holding member 16, and for example, a base member seep recess of the same form as that described above may be provided in just the base member 30 or the base member seep opening 16*c* may be provided in the lower holding member 16 and a base member seep recess may be provided in the base member 30.

A structure, wherein a metal exhaust tube 19 is disposed at a central portion of the stem 29 in the same manner as the photomultiplier 20 shown in FIG. 11, may be employed with the photomultiplier 28 as well. Also, an arrangement may be employed wherein a side tube 27, which is longer in length than the side tube 2, is fitted to the ring-like side tube 7, provided with a flange portion at its lower end, and the flange portions of the side tubes are fixed together by welding as in the photomultiplier 26 shown in FIG. 12.

In arranging a radiation detector equipped with the photomultiplier 28, by arranging in the same manner as the radiation detectors 21 and 25 shown in FIG. 13 to FIG. 14 and FIG. 15 to FIG. 16, a radiation detector exhibiting the same actions and effects described above and is especially suitable for surface mounting can be provided.

As described above, with this invention's photomultiplier and radiation detector, when a holding member is joined to the inner surface of the base member, the predetermined characteristics can be obtained and the seating property of the electron multiplier unit is improved. Also, in the case where a holding member is joined to the outer surface of the base member, the dimensional precision of the total length of the photomultiplier and the mounting property regarding surface mounting of the photomultiplier are improved.

What is claimed is:

1. A photomultiplier comprising:

a photoelectric surface disposed inside a sealed container, which is put in a vacuum state, and converting incident light made incident through a light receiving plate into electrons, which forms an end portion at one side of the sealed container;

an electron multiplier unit disposed inside the sealed container and multiplying electrons emitted from the photoelectric surface;

an anode disposed inside the sealed container and used for taking out the electrons multiplied by the electron multiplier unit as an output signal;

a stem forming an end portion at the other side of the sealed container and having a base member, with an insulating property, and a holding member, having a melting point higher than that of the base member and being joined to one of an inner surface and an outer surface of the base member; and a plurality of stem pins insertedly mounted in the stem and leading to the exterior from inside the sealed container and electrically connected to the anode and the electron multiplier unit, wherein the stem pins are passed through and joined to the base member, and the electron multiplier unit and the anode are layered on the inner surface of the stem, and the base member and the holding member, and the base member and the stem pins are respectively joined by fusion by the melting of the base member, and a base member seep portion, into which the base member seeps upon melting, is disposed in at least one of the holding member and the base member.

2. The photomultiplier according to claim 1, wherein the holding member has a plurality of openings, through which the stem pins joined to the base member are inserted, and among the openings, at least two are made larger in diameter than the other openings.

3. A radiation detector comprising:

a photomultiplier including:

a photoelectric surface disposed inside a sealed container, which is put in a vacuum state, and converting incident light made incident through a light receiving plate into electrons, which forms an end portion at one side of the sealed container;

an electron multiplier unit disposed inside the sealed container and multiplying electrons emitted from the photoelectric surface;

an anode disposed inside the sealed container and used for taking out the electrons multiplied by the electron multiplier unit as an output signal;

a stem forming an end portion at the other side of the sealed container and having a base member, with an insulating property, and a holding member, having a melting point higher than that of the base member and being joined to one of an inner surface and an outer surface of the base member; and a plurality of stem pins insertedly mounted in the stem and leading to the exterior from inside the sealed container and electrically connected to the anode and the electron multiplier unit, wherein the stem pins are passed through and joined to the base member, and the electron multiplier unit and the anode are layered on the inner surface of the stem, and the base member and the holding member, and the base member and the stem pins are respectively joined by fusion by the melting of the base member; and a base member seep portion, into which the base member seeps upon melting, is disposed in at least one of the holding member and the base member; and a scintillator, convening radiation into light and emitting the light, installed at the outer side of the light receiving plate of the photomultiplier.

* * * * *